US010184256B2

(12) United States Patent
Melic

(10) Patent No.: US 10,184,256 B2
(45) Date of Patent: Jan. 22, 2019

(54) COLLAPSIBLE SAFETY BARRIER AND SUPPORT POST

(71) Applicant: Jonathan Jonny Melic, Richmond Hill (CA)

(72) Inventor: Jonathan Jonny Melic, Richmond Hill (CA)

( * ) Notice: Subject to any disclaimer, the term of this patent is extended or adjusted under 35 U.S.C. 154(b) by 36 days.

(21) Appl. No.: 15/128,230

(22) PCT Filed: Mar. 23, 2015

(86) PCT No.: PCT/CA2015/050225

§ 371 (c)(1),
(2) Date: Sep. 22, 2016

(87) PCT Pub. No.: WO2015/143555

PCT Pub. Date: Oct. 1, 2015

(65) Prior Publication Data

US 2017/0096824 A1 Apr. 6, 2017

Related U.S. Application Data

(60) Provisional application No. 62/088,998, filed on Dec. 8, 2014, provisional application No. 61/969,915, filed on Mar. 25, 2014.

(51) Int. Cl.
*E04G 21/32* (2006.01)
*E04F 11/18* (2006.01)
(Continued)

(52) U.S. Cl.
CPC ..... *E04G 21/3233* (2013.01); *E04F 11/1865* (2013.01); *E04G 21/3228* (2013.01); *E04G 25/08* (2013.01); *E04G 2007/285* (2013.01)

(58) Field of Classification Search
CPC ..... E04G 25/08; E04G 2007/285; E04G 21/3228–21/3233; E04G 21/3223; E04F 11/1865
See application file for complete search history.

(56) References Cited

U.S. PATENT DOCUMENTS 2,413,921 A 1/1947 Jaspersen
3,662,993 A 5/1972 Lionetto
(Continued)

FOREIGN PATENT DOCUMENTS

CH 705983 A1 7/2013
CN 2013177682 A1 12/2013
(Continued)

OTHER PUBLICATIONS

Extended European Search Report, for European Patent Application No. 15768243.5, dated Nov. 16, 2017, 9 pages.
(Continued)

*Primary Examiner* — Babajide A Demuren
(74) *Attorney, Agent, or Firm* — Kinney & Lange, P.A.

(57) ABSTRACT

A collapsible safety barrier and support post for releasably securing between a ceiling structure and a floor structure. The safety barrier and support post comprises a plurality of longitudinal rails hingedly secured to a first end post and to a second end post, an extension rail releasably engageable with the second end post, and a latching mechanism to releasably secure the extension rail to the second end post. The safety barrier has a deployed position and a collapsed position. When in its deployed position the barrier is secured between a floor and a ceiling structure. When in its collapsed position the longitudinal rails, the first and second end posts, and the extension rail are positioned generally parallel and adjacent to one another.

14 Claims, 36 Drawing Sheets

(51) Int. Cl.
*E04G 25/08* (2006.01)
*E04G 7/28* (2006.01)

(56) References Cited

U.S. PATENT DOCUMENTS

| | | | | | |
|---|---|---|---|---|---|
| 3,883,106 | A * | 5/1975 | Simonsen | ..... | E04G 21/3233 248/200.1 |
| 4,773,506 | A | 9/1988 | Preston | | |
| 6,279,880 | B1 * | 8/2001 | Hawks, Jr. | ..... | E04G 21/3219 256/65.03 |
| 7,000,673 | B2 * | 2/2006 | Cook | ..... | E06B 11/02 160/210 |
| 9,500,000 | B2 * | 11/2016 | McCarty | ..... | E04H 17/1413 |

FOREIGN PATENT DOCUMENTS

| | | | | | |
|---|---|---|---|---|---|
| EP | 2472030 | A1 | | 7/2012 | |
| FR | 40141 | E | * | 4/1932 | ..... E04G 25/08 |
| FR | 3021988 | A1 | * | 12/2015 | ..... E04G 21/3204 |
| GB | 2468688 | A | * | 9/2010 | ..... E04G 21/3233 |
| GB | 2456863 | B | * | 9/2012 | ..... E04G 21/3223 |
| WO | WO2010/106371 | A1 | | 9/2010 | |

OTHER PUBLICATIONS

International Preliminary Report on Patentability for PCT application No. PCT/CA2015/0050225, dated Oct. 6, 2016, 6 pages.
International Search Report and Written Opinion from PCT Application Serial No. PCT/CA2015/050225, dated Jun. 23, 2015, 8 pages.

* cited by examiner

Detail "A"

COLLAPSIBLE SAFETY BARRIER AND SUPPORT POST

FIELD

This invention relates generally to safety barriers or safety fences, and in particular to a collapsible safety barrier and support post.

BACKGROUND

The construction of modern multi-floor buildings often requires temporary barriers to be erected about the building's perimeter on each floor until the exterior walls or cladding can be installed. Such barriers help to ensure the safety of construction personnel and also the safety of passersby on the ground through preventing construction material and debris from being blown or otherwise falling from a building while under construction. Ideally such barriers should be capable of withstanding a predetermined load and should be both easy to install and easy to dismantle. Commonly, the barriers are either supported between the concrete or wooden floor systems and the ceiling system directly above or through fastening directly to the floor system. In multi-floor high-rise construction, safety barriers will typically be moved from floor to floor as the building is constructed.

Others have proposed a wide variety of different support posts and safety barriers for use in such applications. Most commonly, the posts are installed between the floor system and a ceiling directly above, and are either tensioned in place or held through any one of a wide variety of mechanical fastening mechanisms. Once the posts are installed, sections of safety barrier or safety fence are then commonly wired, clipped or otherwise fastened to, or between, the posts in order to create an integral safety barrier system about the perimeter of the building. While such systems in most cases provide an adequate barrier and protection for those working at height on the construction site, as well as individuals passing by on the ground, they can in many cases be laborious to install, requiring an installer to "set" posts in place and then subsequently move barriers or fence panels into position and secure them to the posts. In addition, the physical size of the fence panels (which can often approach 3 feet by 8 feet) can at times present difficulties or obstacles with respect to the movement of the panels from place to place. The sheer size of the panels can make them in some instances awkward to manoeuvre within a new building under construction, within the surrounding jobsite, and on trucks and trailers that move the panels from one job site to another.

SUMMARY

The invention therefore provides a collapsible safety barrier and support post for releasably securing between a ceiling structure and a floor structure.

In one of its aspects the invention provides a collapsible safety barrier and support post for releasably securing between a ceiling structure and a floor structure wherein the safety barrier and support post comprises a plurality of longitudinal rails having first ends hingedly secured to a first end post and having second ends hingedly secured to a second end post; an extension rail releasably engageable with said second end post, one of said second end post and said extension rail having floor engaging means and the other of said second end post and said extension rail having ceiling engaging means, said second end post and said extension rail together comprising the support post; a latching mechanism to releasably secure said extension rail to said second end post, said latching mechanism having an engaged and a disengaged position, when in said engaged position said latching mechanism resisting relative longitudinal movement between said extension rail and said second end post, when in said disengaged position said latching mechanism permitting relative longitudinal movement between said extension rail and said second end post; said safety barrier having a deployed position and a collapsed position, when in said deployed position said floor engaging means engaged with the floor structure and said ceiling engaging means engaged with the ceiling structure, when in said collapsed position said longitudinal rails, said first and second end posts, and said extension rail positioned generally parallel and adjacent to one another and said ceiling engaging means disengaged from the ceiling structure.

In a further aspect the invention provides a collapsible safety barrier and support post for releasably securing between a ceiling structure and a floor structure, the safety barrier and support post comprising a plurality of longitudinal rails, said longitudinal rails having first and second ends, said first ends hingedly secured to a first end post, and said second ends hingedly secured to a second end post, said second end post having a floor engaging means; an extension rail releasably engageable to said second end post, said extension rail having an upper end with a ceiling engaging means and a lower end having a clamping foot that is slidably receivable about said second end post, said second end post and said extension rail together comprising the support post; a latching mechanism to releasably secure said extension rail to said second end post, said latching mechanism having an engaged and a disengaged position, when in said engaged position said latching mechanism causing said clamping foot to secure said extension rail to said second end post to thereby resist longitudinal movement of said extension rail relative to said second end post, when in said disengaged position said latching mechanism permitting longitudinal movement of said extension rail relative to said second end post, said safety barrier and support post having a deployed position and a collapsed position, when in said deployed position said floor engaging means engaged with the floor structure and said ceiling engaging means engaged with the ceiling structure, when in said collapsed position said longitudinal rails, said first and second end posts, and said extension rail positioned generally parallel and adjacent to one another, and said ceiling engaging means disengaged from the ceiling structure.

In a further aspect the invention provides a collapsible safety barrier and support post for releasably mounting on a surface, the safety barrier and support post comprising a plurality of longitudinal rails hingedly secured to at least one barrier post, said longitudinal rails and said barrier post collectively forming a collapsible safety barrier, and a support post in the form of a foot for mounting on the surface, said foot including a tubular portion with a generally hollow interior to receive at least a portion of said barrier post, said foot having a longitudinally oriented channel communicating the exterior of said foot with said generally hollow interior, said channel receiving a portion of said safety barrier therethrough when said barrier post is received within the generally hollow interior of said tubular portion, when said foot is mounted on said surface with said barrier post received within said tubular portion, said foot retaining said safety barrier generally perpendicular to the surface and accommodating horizontal load applied to said safety barrier.

In a further aspect the invention provides a collapsible safety barrier and support post for releasably mounting on a surface, the safety barrier and support post comprising a plurality of longitudinal rails having first ends hingedly secured to a first end post and having second ends hingedly secured to a second end post, said longitudinal rails and said end posts collectively forming a collapsible safety barrier, and a support post in the form of a foot for mounting on the surface, said foot including a tubular portion with a generally hollow interior to receive at least a portion of one of said end posts, said foot having a longitudinally oriented channel communicating the exterior of said foot with said generally hollow interior, said channel receiving a portion of said safety barrier therethrough when one of said first and said second end posts is received within the generally hollow interior of said tubular portion, when said foot is mounted on the surface with one of said first and said second end posts received within said tubular portion, said foot retaining said safety barrier generally perpendicular relative to the surface and accommodating horizontal load applied to said safety barrier.

Further aspects of the invention will become apparent from the following description taken together with the accompanying drawings.

BRIEF DESCRIPTION OF THE DRAWINGS

For a better understanding reference will now be made, by way of example, the accompanying drawings which show exemplary embodiments of the present invention in which:

FIG. 3 also depicts the ability to remove the extension rail portion of the support post from the second end post.

FIG. 7 also includes an enlarged detail view of portion "A".

FIG. 29A is an enlarged view of portion "A" of FIG. 29.

FIG. 32A is an enlarged detail of portion "A" of FIG. 32.

FIG. 34A is an enlarged detail view of portion "A" of FIG. 34.

FIG. 36A is an enlarged detail view of portion "A" of FIG. 36.

DESCRIPTION

The present invention may be embodied in a number of different forms. The specification and drawings that follow describe and disclose some of the specific forms of the invention.

Figure 1:
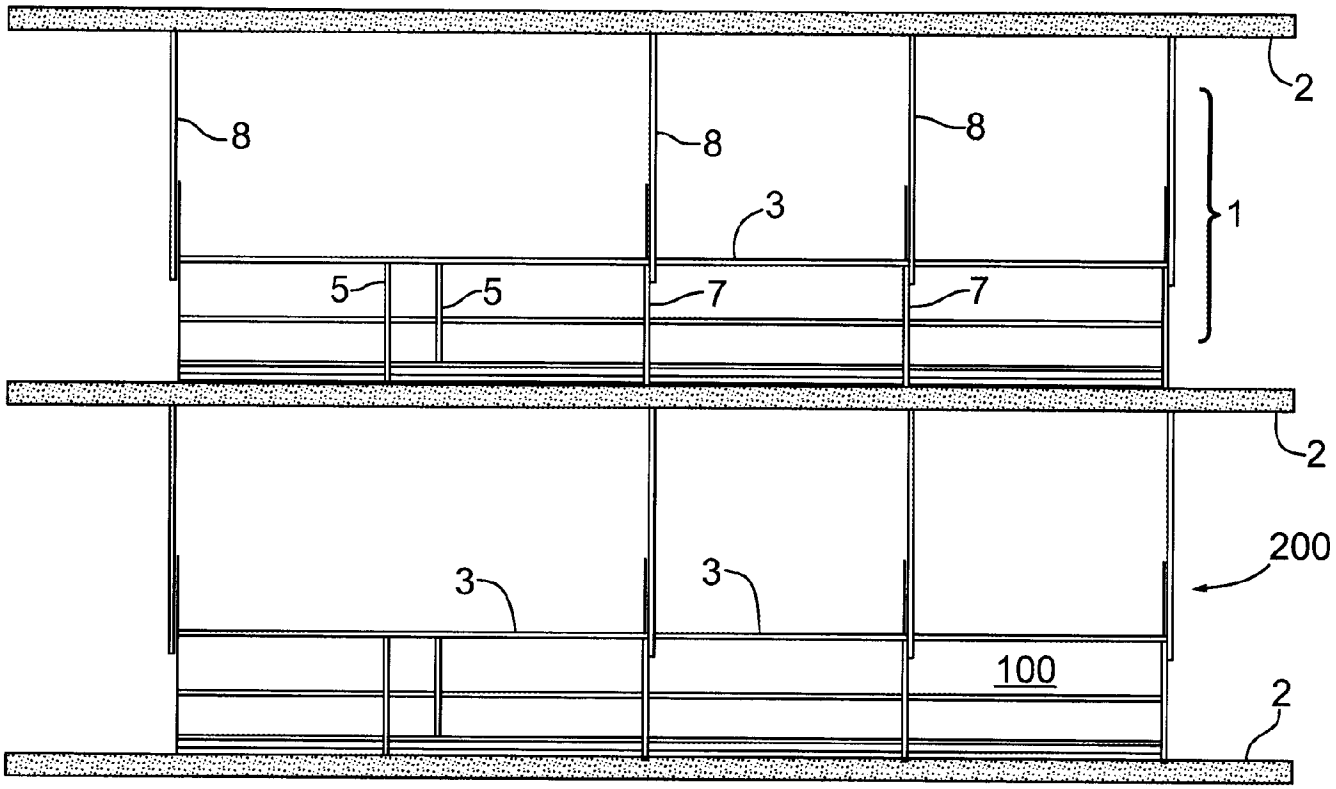
FIG. 1 is a side view of two floors of a building under construction showing the application of a collapsible safety barrier and support post in accordance with one of the embodiments of the present invention.

With reference to the accompanying drawings there is shown an exemplary embodiment of a collapsible safety barrier and support post 1 constructed in accordance with an embodiment of the invention. In FIG. 1, there is depicted two typical floors of a modern high rise construction where the concrete slabs forming the floor and ceiling structures are noted by reference numeral 2 and with collapsible safety barrier and support post 1 shown as being secured between the respective floor and ceiling structures. In this particular instance three collapsible safety barriers and support posts are shown used in association with each of the two depicted floors.

Figure 2A:
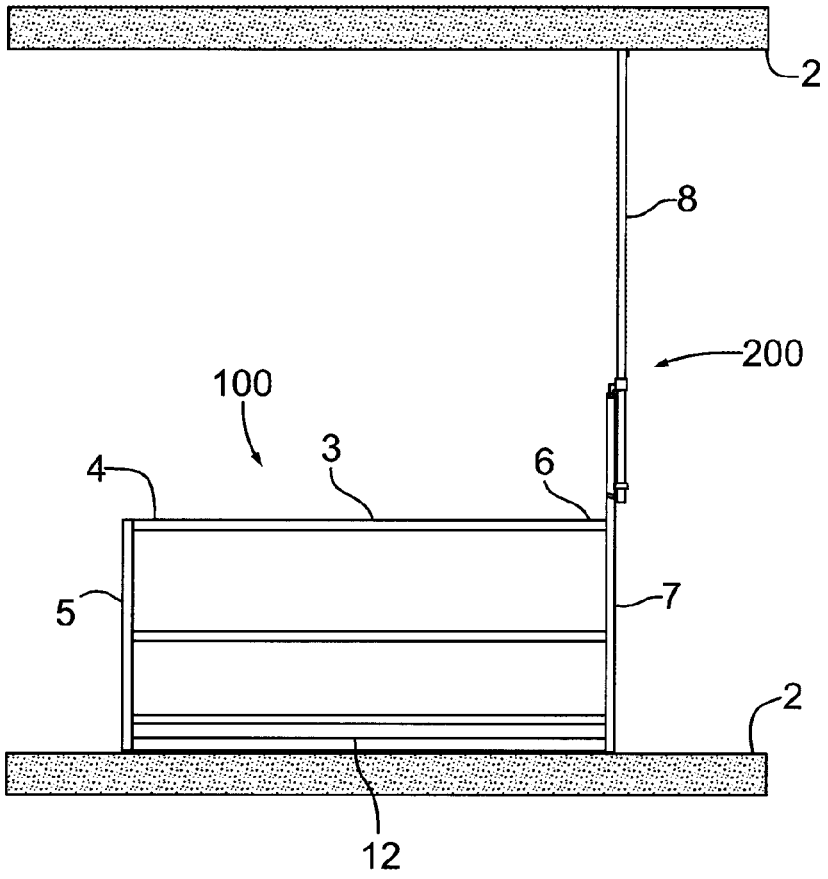
FIG. 2*a* is an enlarged view of one of the safety barriers and support posts shown in FIG. 1, with its extension rail in an extended position.
Figure 2B:
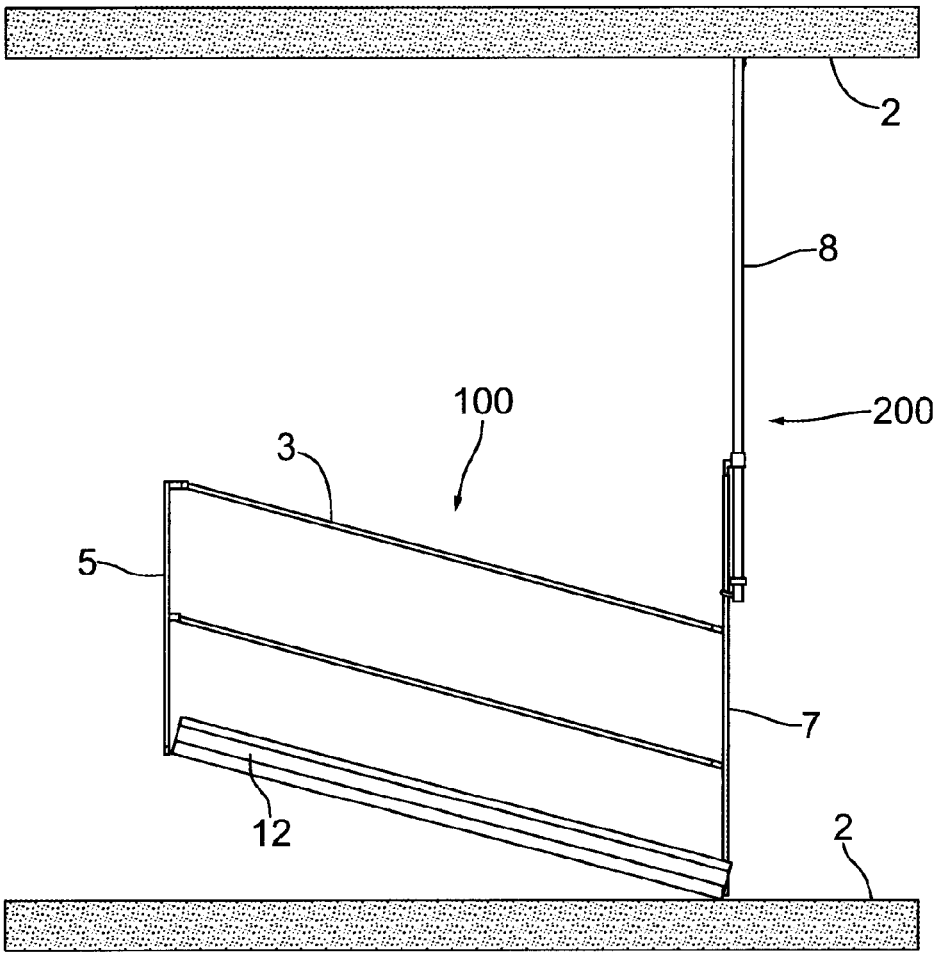
FIG. 2*b* is a view similar to FIG. 2*a* wherein the fence portion of the safety barrier has been partially lifted to allow access between it and the floor structure.
Figure 2C:
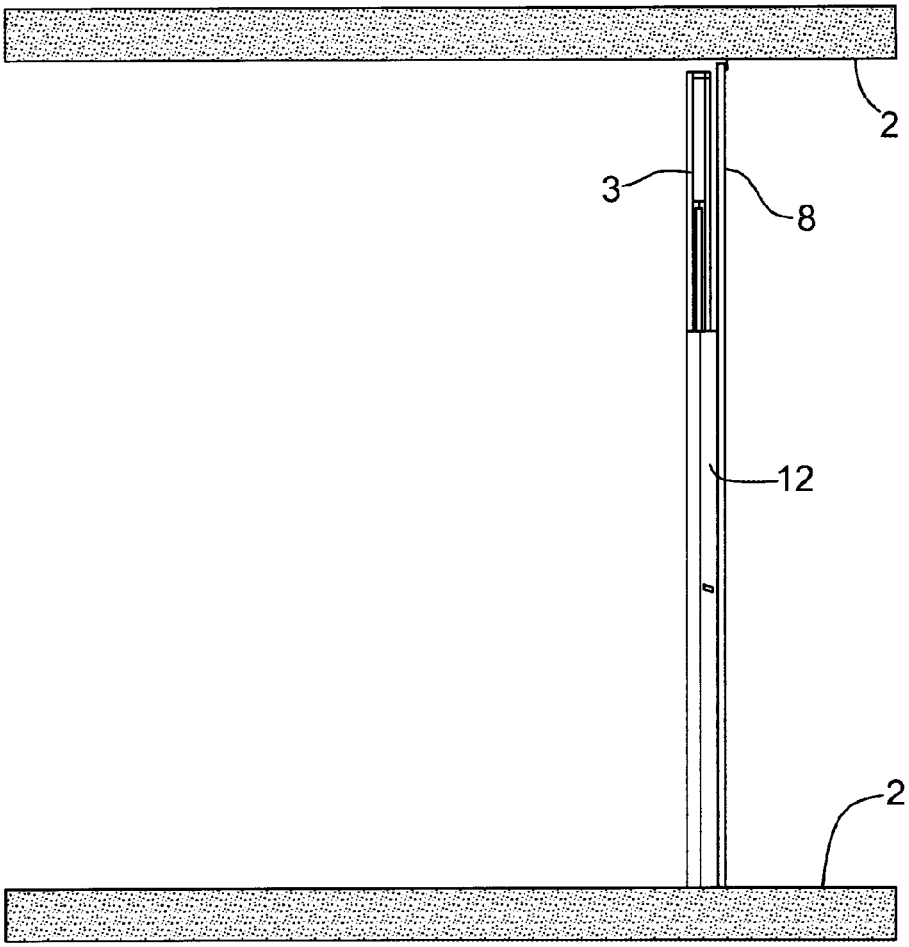
FIG. 2*c* is a view similar to FIG. 2*a* wherein the fence portion of the safety barrier has been folded vertically to align with the support post portion.

FIG. 2*a* shows in isolation one floor of a high rise building wherein a single collapsible safety barrier and support post structure is shown as it would typically be releasably secured between the floor and ceiling structures. The collapsible safety barrier and support post structure is comprised, in general, of a fence portion 100 and a support post portion 200. FIG. 2*b* shows the collapsible safety barrier and support post structure of FIG. 2*a* wherein the fence portion has been rotated upwardly to allow for passage between it and the floor structure. FIG. 2*c* shows the collapsible safety barrier and support post structure of FIGS. 2*a* and 2*b* wherein the fence portion has been rotated upwardly in a vertical configuration adjacent to the support post portion.

Figure 2D:
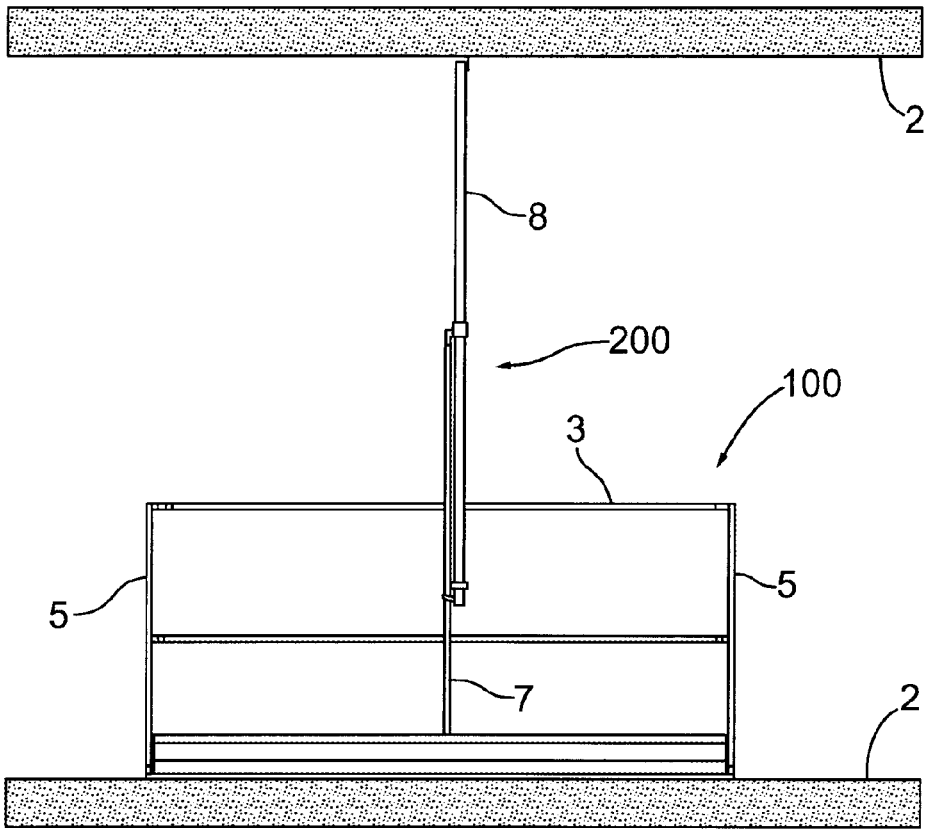
FIG. 2*d* is a view similar to FIG. 2*a* wherein the safety post is positioned at or near the middle of the fence portion of the safety barrier.
Figure 2E:
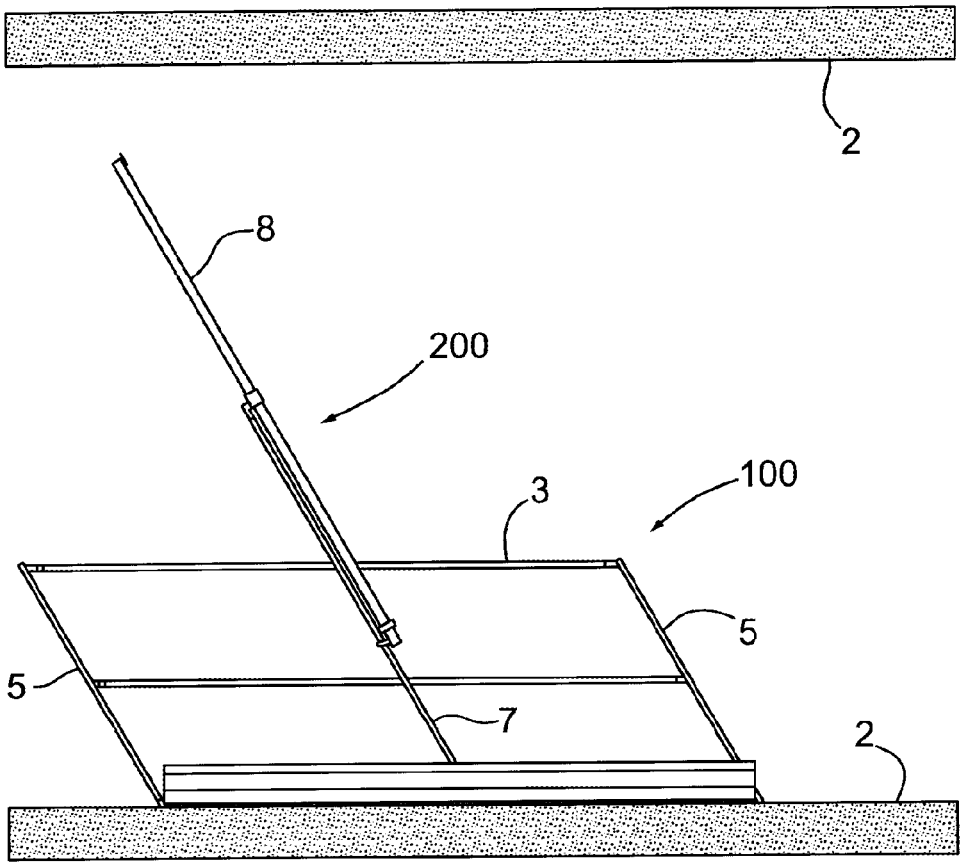
FIG. 2*e* is a view similar to FIG. 2*d* showing the collapsible safety barrier and support post in the process of being collapsed or folded in a direction toward the left.
Figure 2F:
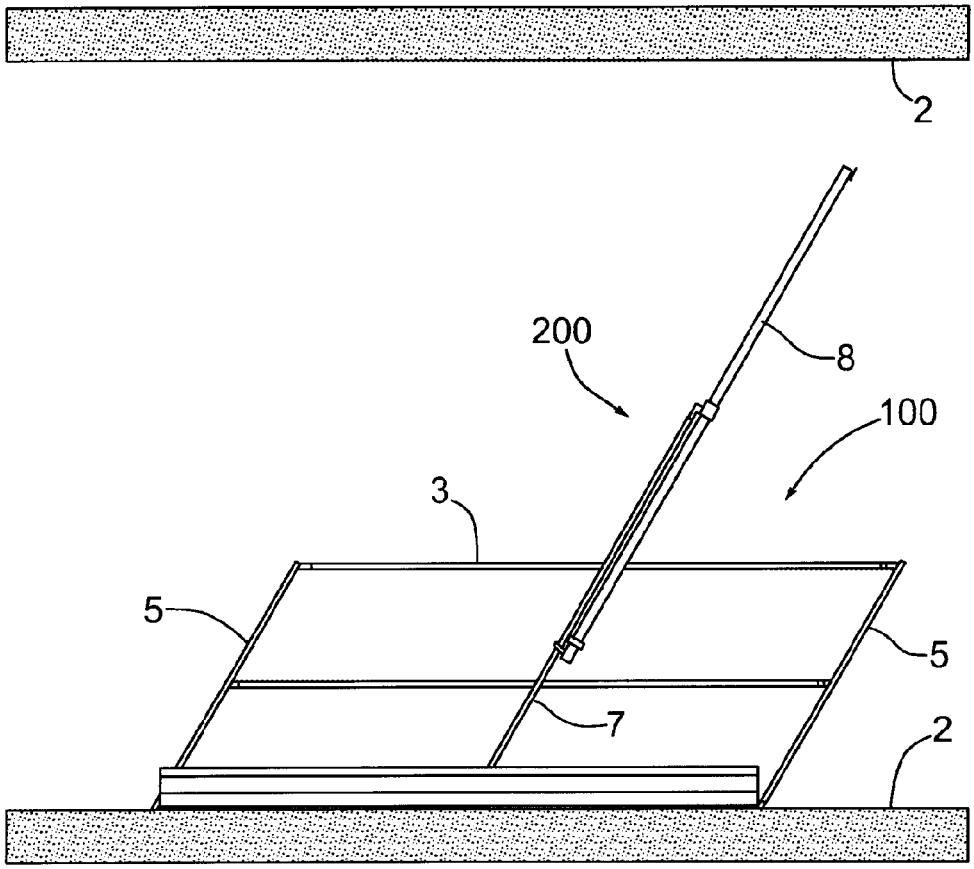
FIG. 2*f* is a view similar to FIG. 2*d* showing the collapsible safety barrier and support post in the process of being collapsed or folded in a direction toward the right.
Figure 5:
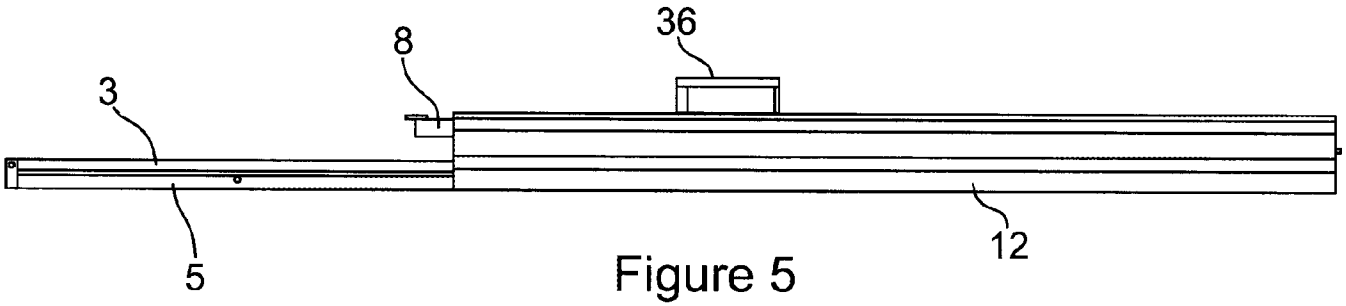
FIG. 5 is a bottom view of the safety barrier and support post shown in FIG. 4 in a fully collapsed position.
Figure 6:
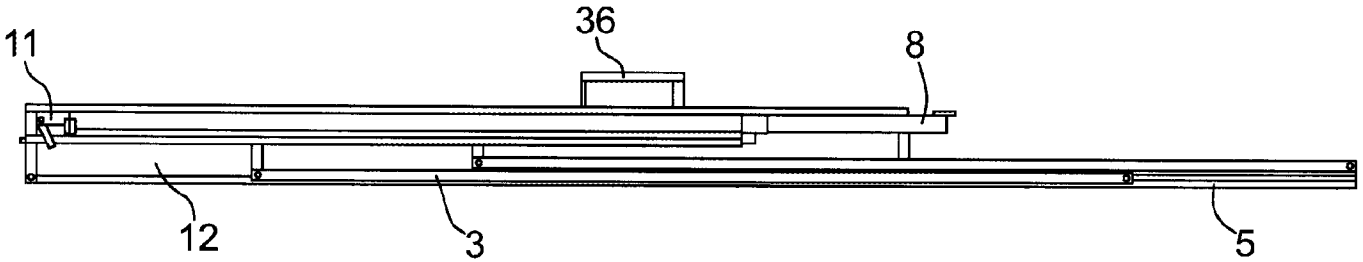
FIG. 6 is a top view of the safety barrier and support post shown in FIG. 5.

In one embodiment device 1 is comprised generally of a plurality of longitudinal rails 3 having first ends 4 that are hingedly secured to a first barrier or end post 5. Longitudinal rails 3 have second ends 6 that are hingedly secured to a second barrier or end post 7. It will be appreciated from a thorough understanding of the invention that a variety of different mechanisms and manners of hingedly connecting the ends of longitudinal rails 3 to first and second end posts 5 and 7 could be utilized. In the embodiment depicted, the hinge connection is achieved through the use of a bolt that extends either through both the end post and the respective end of a longitudinal rail, or through the use of a bolt and flanges that are mounted to either or both of the end posts and/or to the end of the longitudinal rail. A slightly varied embodiment of the invention shown in FIG. 2*a* is depicted in FIGS. 2*d*, 2*e* and 2*f*. Here, the support post portion 200 is positioned at or near the middle of the fence portion 100. In this embodiment longitudinal rails 3 are rotatably fastened to support post portion 200 so that the fence portion can be collapsed into generally the same plane as the support post portion. Regardless of the embodiment, rails 3 and the end (barrier) post or posts are rotatable relative to one another to allow the fence to be collapsed into the same general plane, as is discussed in greater detail below and is shown in FIGS. 5 and 6.

In one embodiment, device 1 further includes an extension rail 8 that is releasably engagable with second end post 7. Further, at least one of extension rail 8 and second end post 7 typically will have a floor engaging means with at least the other of the second post and the extension rail having a ceiling engaging means. In the embodiment shown in the FIGS. 2*a* through 2*f*, second end post 7 includes a floor engaging means 9 and extension rail 8 includes a ceiling engaging means 10. Floor and ceiling engaging means 9 and 10 can be any one of a variety of commonly utilized structures for such applications and would typically have some form of pointed or other friction engaging or enhancing structure that helps to secure (in this embodiment) the second end post to the floor structure and the extension rail to the ceiling structure when the respective floor and ceiling engaging means are in contact with the respective floor and ceiling structures. Alternately the floor and ceiling engaging means could be in the form of plates or flanges that are secured to the floor and ceiling structures through the use of fasteners. In this embodiment, second end post 7 and extension rail 8 together function as and comprise the support post aspect of collapsible safety barrier and support post 1.

Figure 18:
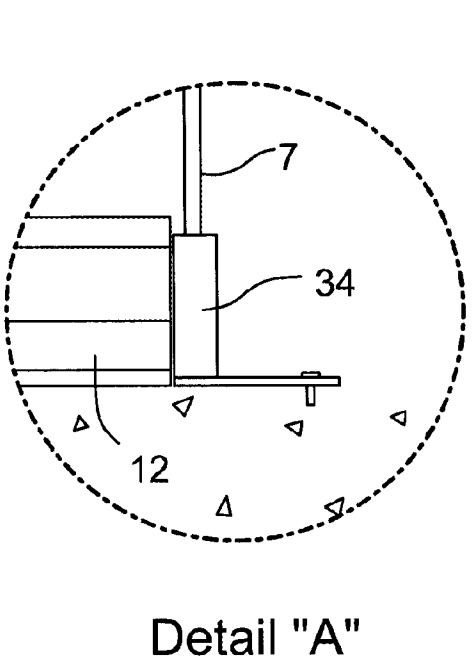
FIG. 18 is a side elevational view of two floors of a building under construction showing the application of a collapsible safety barrier and support post in accordance with a further embodiment of the invention.
Figure 18:
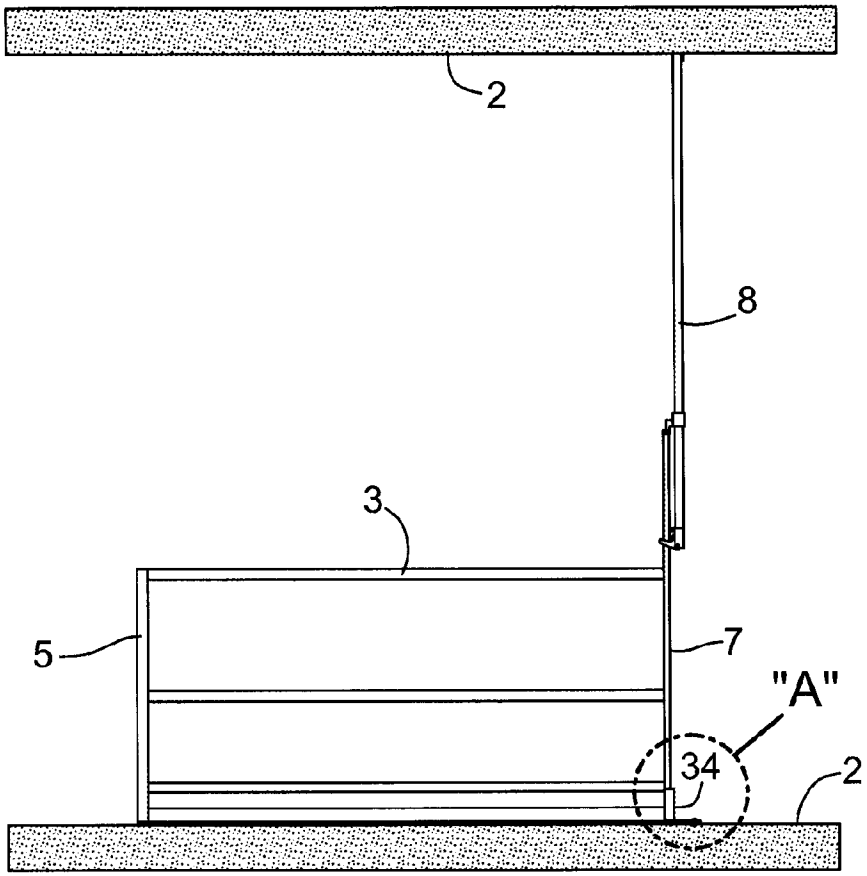
Figure 19:
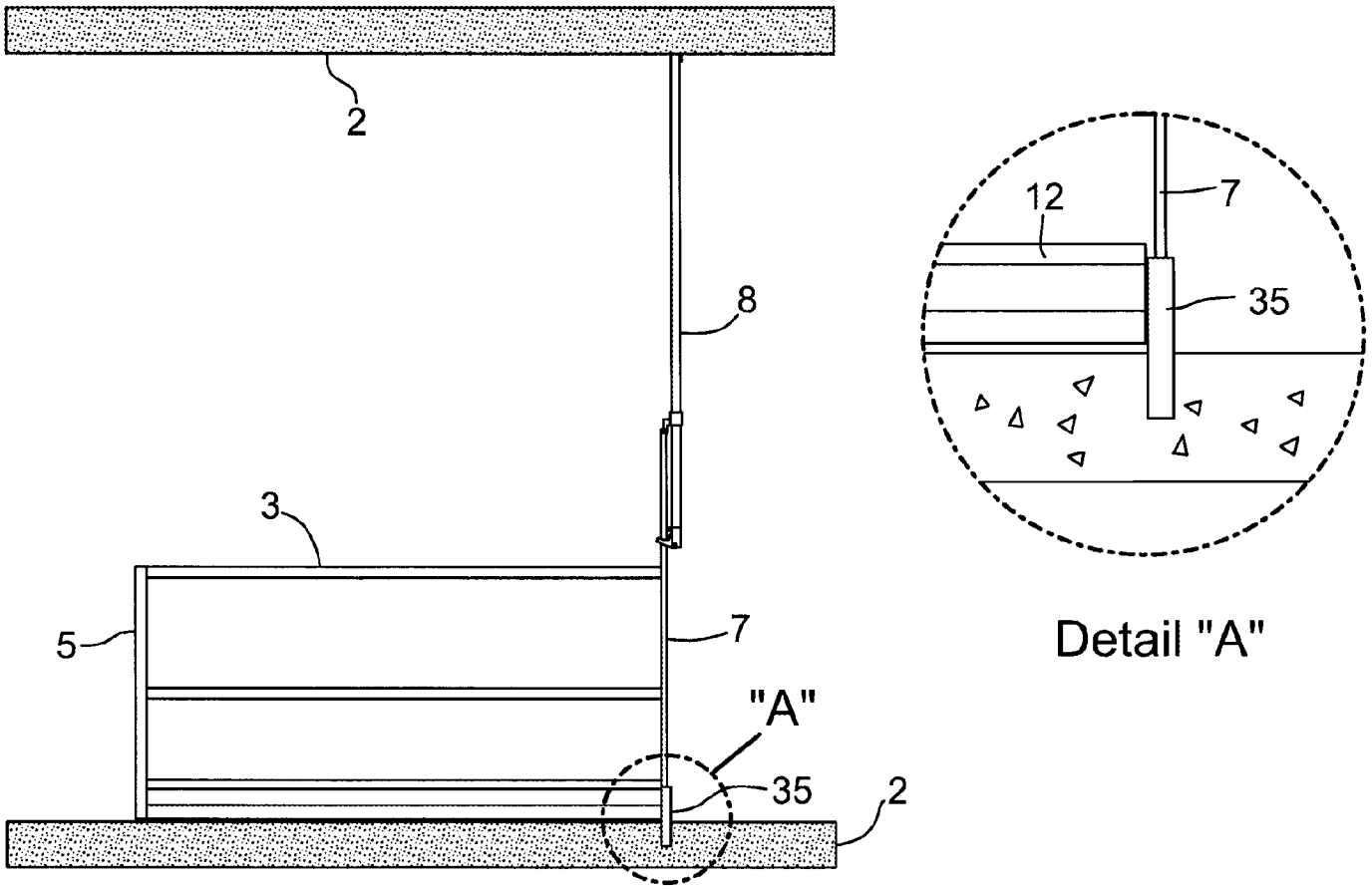
FIG. 19 is a side elevational view of two floors of a building under construction showing the application of a collapsible safety barrier and support post in accordance with yet a further embodiment of the present invention.

Two examples of alternate embodiments of the invention that depict additional mechanisms by which the first and/or second end (or barrier) posts may be secured to the floor structure are shown in FIGS. 18 and 19. In these embodiments the support post includes a sleeve or foot 34 that has a generally hollow interior and that may be secured to a floor structure using one of a wide variety of different mechanisms (which could include adhesives, nails, bolts, or other fasteners). In FIG. 18, sleeve or foot 34 has a lower flange or base that is secured to the floor structure by the one or more fasteners. The lower part of second end post 7 is configured such that it is receivable within the generally hollow interior of sleeve 34 in order to secure the second end post to the floor structure, preventing horizontal displacement of the end post. It will be appreciated that in some instances the sleeve may have a longitudinal channel, slot or gap 77 cut or formed into it to allow for structural elements of the fence portion to extend therethrough. The channel or slot will thus communicate the exterior of the foot with the generally hollow interior. Typically the channel, slot or gap will be vertical when in use. In some instances the channel can also help to prevent rotation of the fence portion about the support post portion and thereby provide further structural rigidity to device 1.

In the case of FIG. 19, a sleeve 35 is cast or later inserted into the floor structure. The top of the sleeve may either protrude from the floor (as shown in FIG. 19) or it may be essentially flush with the top of the floor structure. Here, the lower end of second end post 7 is received within the generally hollow interior of sleeve 35 to prevent horizontal displacement of the end post relative to the floor structure. As in the embodiment of FIG. 18, the sleeve may have a vertical channel 77. It will further be appreciated that if desired the first and/or second end posts could be secured to the floor structure through the receipt of the lower end of the posts within a hole or bore in the floor structure, and without the utilization of a dedicated and separate sleeve.

Figure 20:
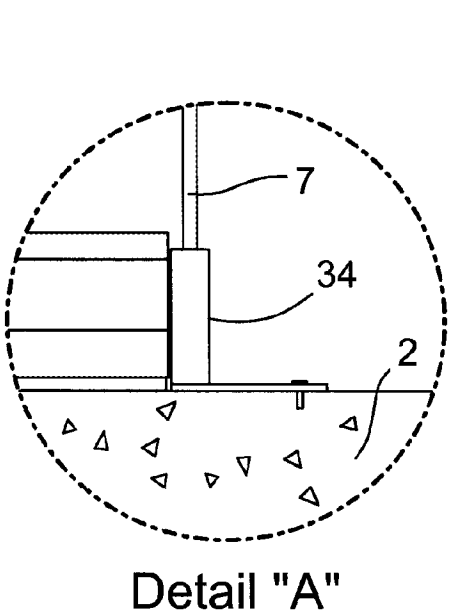
FIG. 20 is a side elevational view of two floors of a building under construction showing the application of a collapsible safety barrier and support post in accordance with a further embodiment of the invention.
Figure 20:
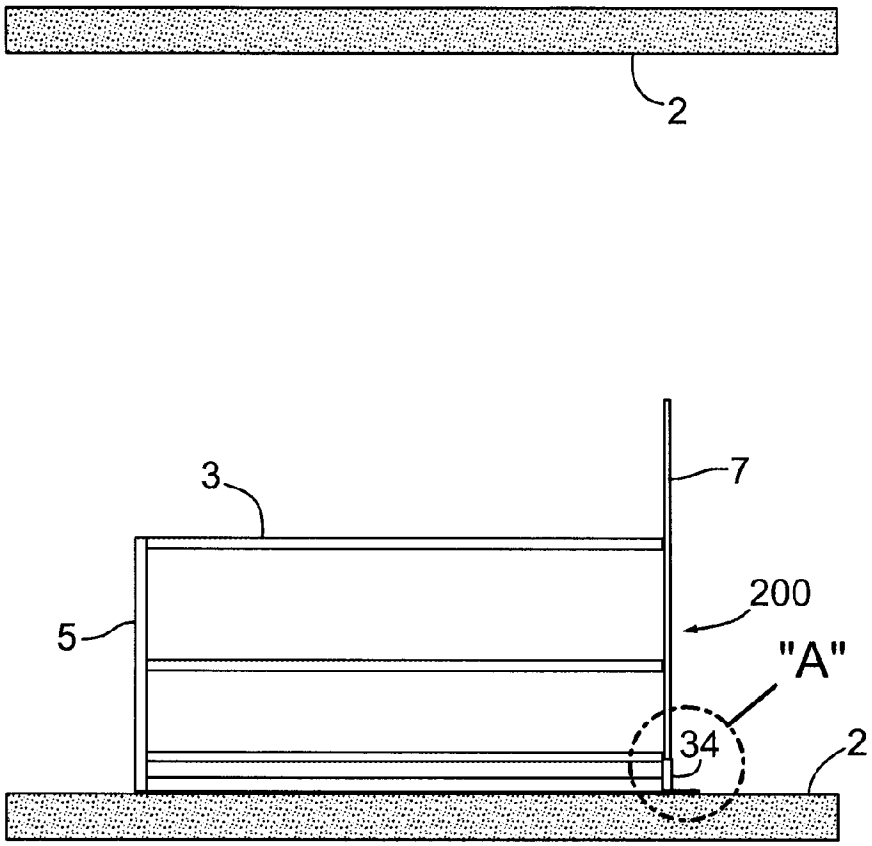
Figure 21:
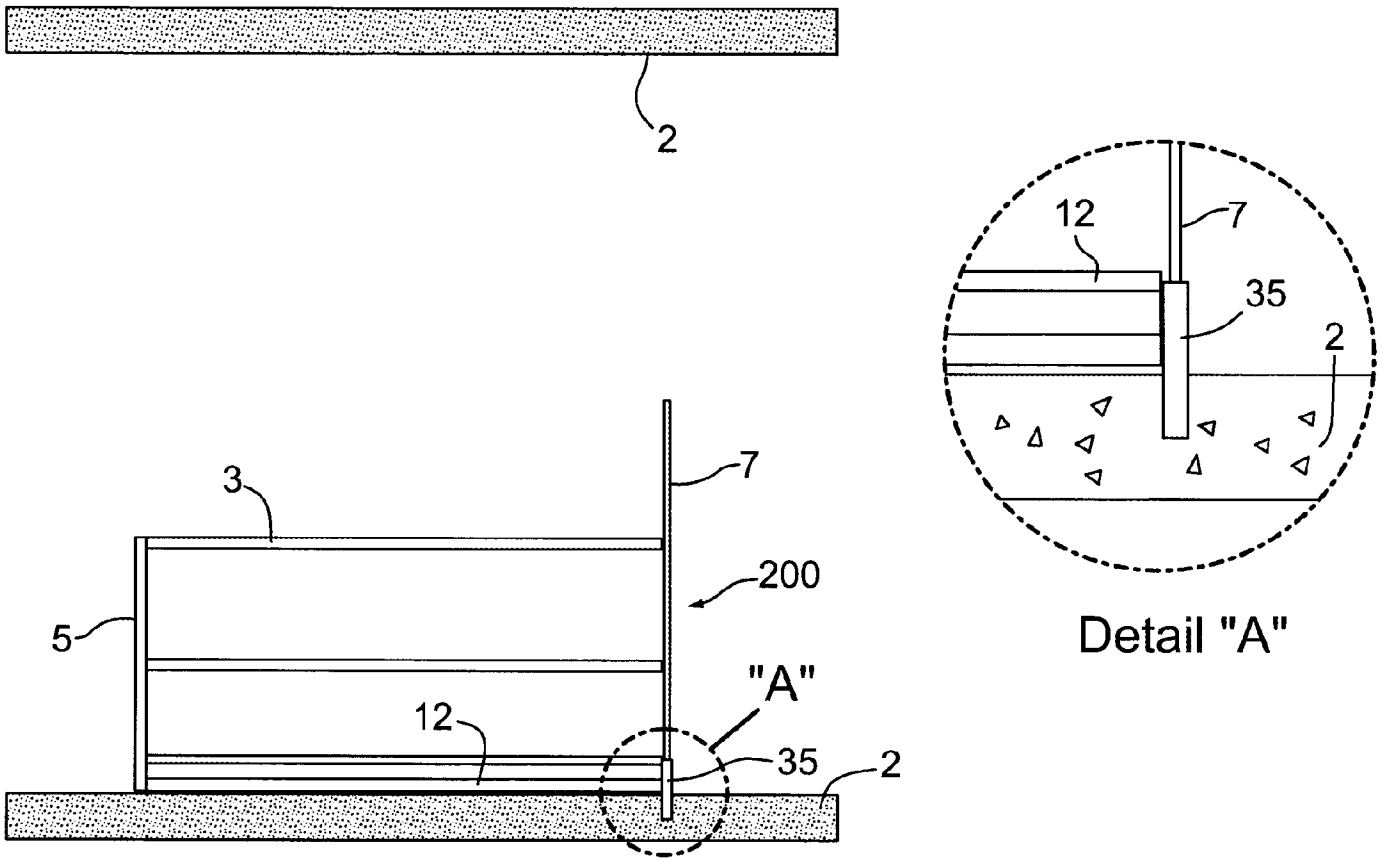
FIG. 21 is a side elevational view of two floors of a building under construction showing the application of a collapsible safety barrier and support post in accordance with yet a further embodiment of the present invention.
Figure 22:
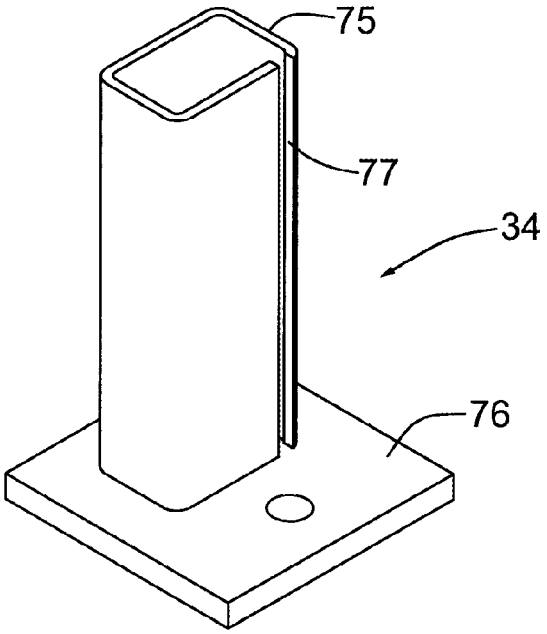
FIG. 22 is an enlarged side view of the sleeve or foot 34 shown in FIG. 20.
Figure 23:
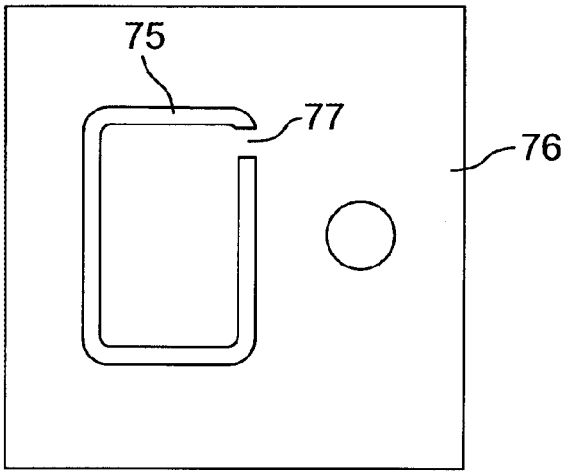
FIG. 23 is a top plan view of the sleeve or foot of FIG. 22.
Figure 24:
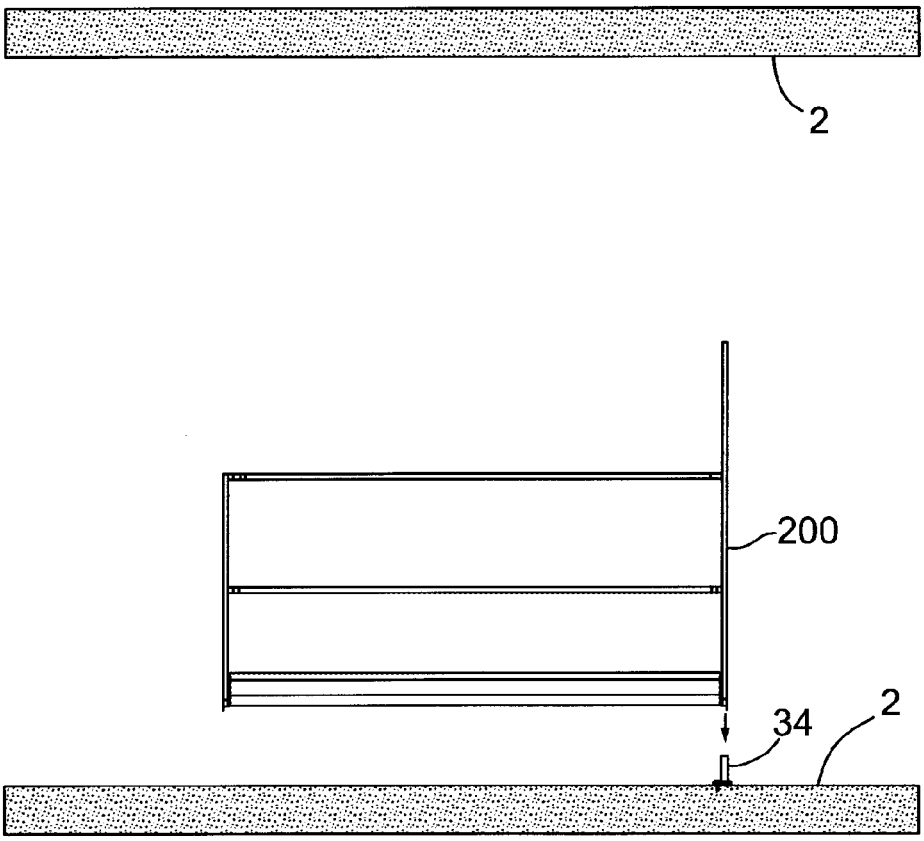
FIG. 24 is a side elevational view of the sleeve or feet of FIG. 22 showing a collapsible safety barrier about to be engaged therewith.
Figure 25:
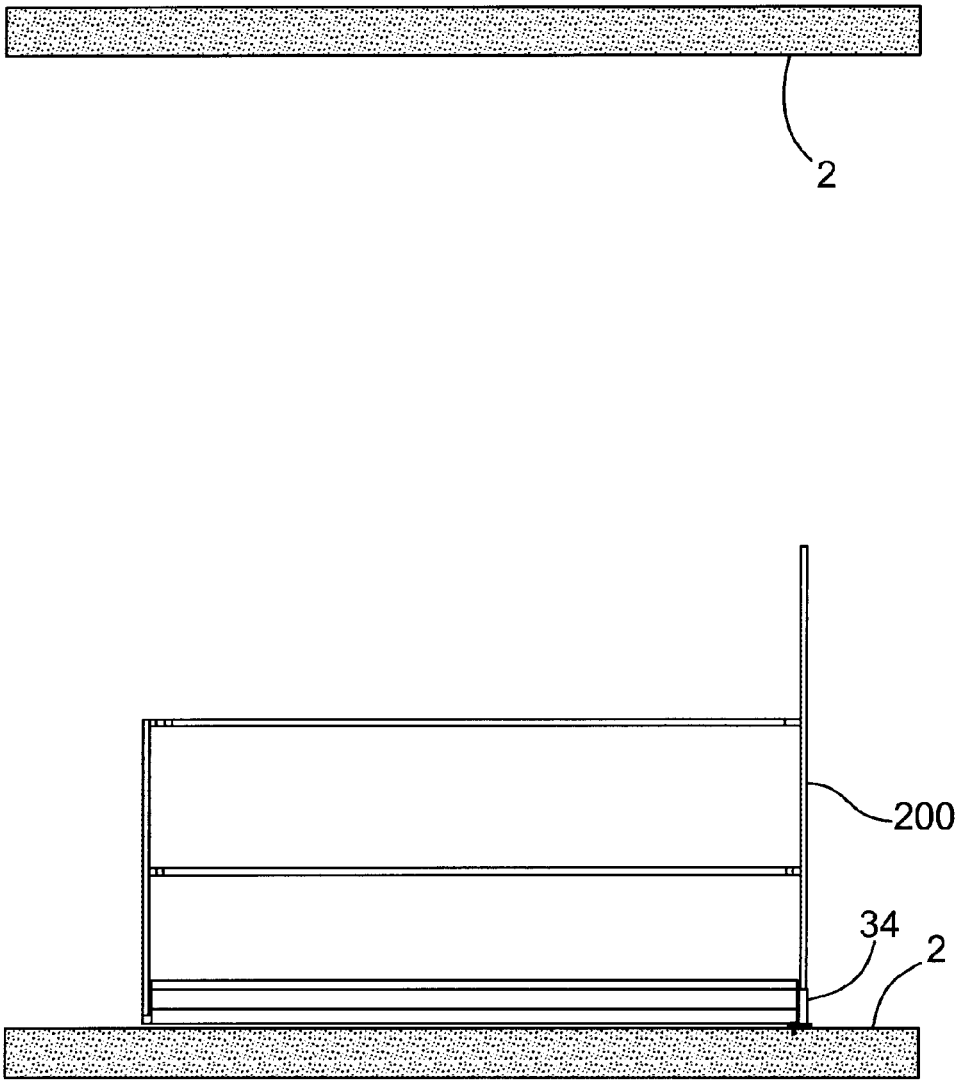
FIG. 25 is a view similar to FIG. 24 wherein the collapsible safety barrier has been received within the sleeve or f00t.
Figure 26:
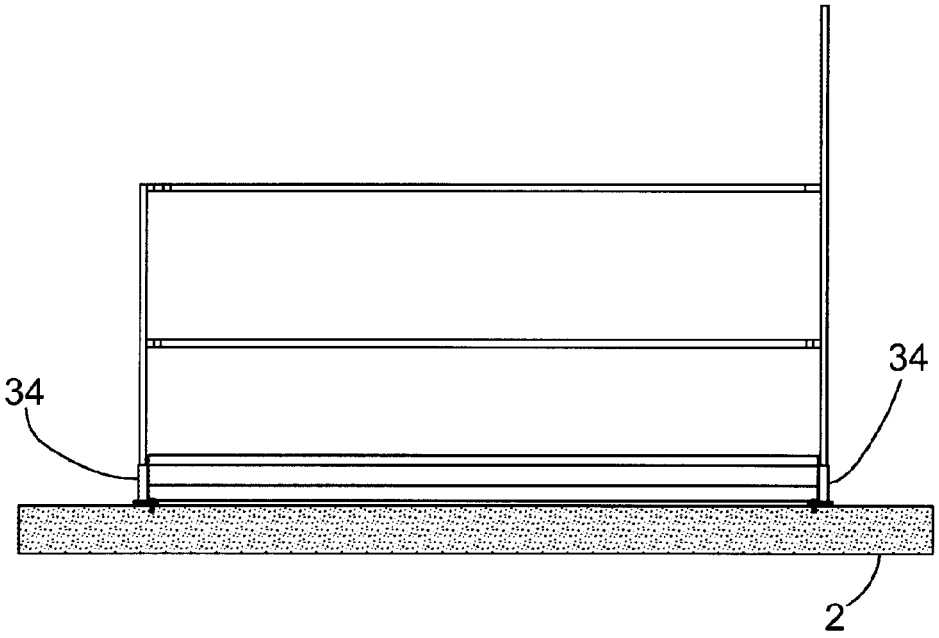
FIG. 26 is a view similar to FIG. 25 wherein a sleeve or foot is shown as securing both ends of the safety barrier to a floor structure.

FIGS. 20 and 21 depict yet further embodiments wherein support post portion 200 includes either sleeve or foot 34 (in the case of FIG. 20) or sleeve or foot 35 (in the case of FIG. 21). In either case the receipt of second end post 7 within a sleeve that is in some fashion secured to the floor structure will permit fence portion 100 to be securely mounted in place without engaging the ceiling structure, and without the need for extension rail 8. At the same time, first end post 5 and the related end of the fence portion is permitted to be lifted or rotated vertically, as is discussed in greater detail below. The fence portion will also be collapsible for storage and transportation, once again as is discussed in further detail below. Further, with second end post 7 received within either sleeve or foot 34 or 35, the fence portion will be self supporting and will not collapse upon itself. The structure thus removes the need for additional horizontal supports or braces that would otherwise be necessary to prevent the collapsible fence portion from folding in upon itself.

It will be appreciated that sleeves 34 and/or 35 may be also used to secure first end post 5 to the floor structure, or to retain both end posts simultaneously.

An embodiment of sleeve or foot 34 is shown more specifically in FIGS. 22 through 26. Here, sleeve or foot 34 is shown as a tubular portion 75 of generally rectangular cross-section for receiving the lower end of either first or second end post 5 or 7 therein. Those of ordinary skill in the art will appreciate that the cross-sectional shape of tubular portion 75 may be an alternate geometric shape provided that post 5 or 7 can be received therein. A flange or base 76 is secured to the lower end of tubular portion 75 to permit sleeve or foot 34 to be secured to or mounted on a floor structure or surface. Commonly, the flange will include one or more holes or openings therethrough for receiving a bolt, screw, pin or other fastener for securing the flange to the floor structure. The base and the tubular portion may intersect at 90 degrees or at an angle of other than 90 degrees, depending on the desired orientation or inclination of the safety barrier.

Channel or gap 77 in most cases (but not all) will run the length of the tubular portion and is sized to permit either the ends of the lower-most longitudinal rails 3, or the flanges mounted to the end post to which the lower rail is attached, to be received through the channel. In this manner, when the collapsible safety barrier is extended to its operating position (where the longitudinal rails are generally horizontal and positioned generally perpendicular to posts 5 and 7 such that the barrier is of an overall rectangular shape) one of posts 5 or 7 can be lowered down into the generally hollow interior of the tubular portion with either the end of the lower-most longitudinal rail or the flange on the post to which the rail is secured received through channel 77. Once the post has been fully inserted into the tubular portion, the post, and hence the entire collapsible safety barrier, will be securely retained in a deployed or operating configuration with the post held generally vertical and the longitudinal rails positioned generally horizontal. Retaining the lower-most portion of the post within the hollow interior of tubular portion 75 will permit the safety barrier to accommodate horizontal loading in all directions, while preventing the barrier from collapsing onto itself or from being horizontally displaced relative to the floor structure. The horizontal loading of the safety barrier will be transmitted from the end or barrier post through tubular portion 75 to flange or base 76, and ultimately to fasteners passing through the base if utilized. Sleeve or foot 34 will thus secure the collapsible safety barrier to a floor system without the need to engage a ceiling structure. The sleeve or flange will also have application on the top floor of a building or a structure, or in other cases where there is no overhead ceiling to which a support post or extension rail 8 can be secured.

A further embodiment of sleeve or foot 34 is shown in FIGS. 27 through 31. In this embodiment tubular portion 75 is comprised of a support 78, a post receiver 79, and a post clamp 80. Support 78 will in most embodiments will be generally perpendicular to flange or base 76 and retains post clamp 80, spaced apart from and generally aligned with post receiver 79. Post receiver 79 is mounted to flange 76, generally hollow and dimensioned to receive therein the lower end of one of posts 5 or 7. It will be appreciated that when the lower end of one of posts 5 or 7 is received within post clamp 80 and post receiver 79, the end post, and hence the safety barrier, will be held perpendicular to flange 76. Where it is desirable incline the safety barrier, receiver 79 and clamp 80 may be held at an angle to flange.

To facilitate the receipt and securement of post 5 or 7 within post clamp 80, the post clamp may be configured such that it will encompass (or substantially encompass) 3 sides of a post of rectangular cross-section. In the particular embodiment shown in the attached Figures, post clamp 80 includes a return 81 that is received about the exterior of the forth side of such a post to help more securely retain the post within the clamp. It will further be appreciated that through manufacturing tolerances it will be possible to retain the post within the clamp solely through frictional engagement. As a means to further enhance the retaining of the post within clamp 80, the clamp may include a threaded bore 82 through which a bolt 83 can be received. In the particular embodiment shown, the threaded bore is in the form of a nut. Through tightening bolt 83 within nut 82, the bolt can be forced against the exterior surface of the post enhancing the securement of the post within clamp 80. The bolt end of the bolt could also be received with a dedicated hole or opening within post 5 or 7. It should also be noted that any one of a wide variety of other retainers, fasteners or fastening mechanisms aside from a threaded bore and bolt could be used (for example straps, spring clips, clasps, eccentric clamp, wedges, etc.) to enhance the integrity of retaining of the post within clamp 80.

In use, the embodiment of sleeve or foot 34 shown in FIGS. 27 through 31 would first typically be secured to a floor or similar structure. When the collapsible safety barrier is extended to its deployed or operating configuration (where the longitudinal rails are generally horizontal and positioned generally perpendicular to posts 5 and 7 such that the barrier is of an overall rectangular shape) the lower end of one of posts 5 or 7 can be inserted into the hollow interior of post clamp 80 with the bottom of the post lowered and retained within post receiver 79. Where a threaded bolt or other fasteners is incorporated within the design, the bolt can be tightened (or the fastener engaged) in order to more securely retain the post within clamp 80. In this manner, the post 5 will be secured by foot or sleeve 34 and retained in a generally vertical orientation relative to the floor structure. With the lower portion of the post thus secured to sleeve or foot 34 the safety barrier will accommodate horizontal loading in all directions, while preventing the barrier from collapsing onto itself or from being horizontally displaced relative to the floor structure. Horizontal loading of the safety barrier will be transmitted from the end or barrier post through post clamp 80, post receiver 79, and vertical support 78 to flange 76, and ultimately to fasteners passing through the flange if utilized. To further enhance the load receiving ability of sleeve or foot 34, a gusset support 84 may extend between base 76 and vertical support 78. As in the case of the embodiment shown in FIGS. 22 through 26, a single sleeve or foot in the form of that shown in FIG. 27 may be utilized at one end of the collapsible safety barrier or, alternatively, a sleeve or foot may be utilized at both ends and used in association with each of end post 5 and 7.

Figure 28:
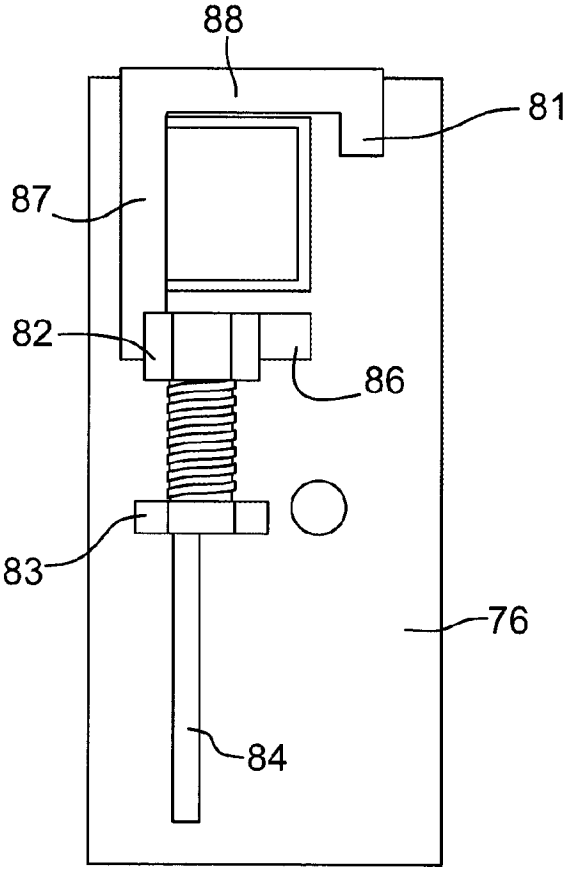
FIG. 28 is a plan view of the sleeve or foot shown in FIG. 27, having an end post or a safety barrier received therein.
Figure 27:
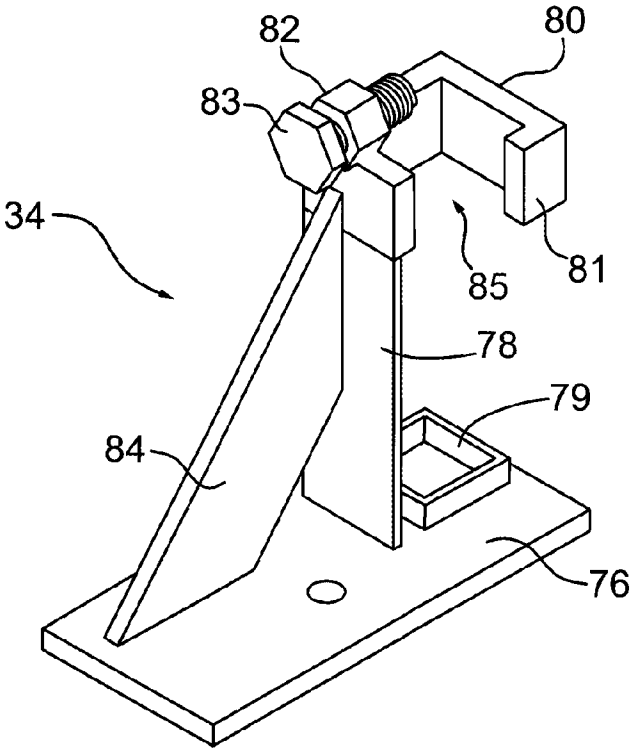
FIG. 27 is an upper side perspective view of an alternate embodiment of the sleeve or foot shown in FIG. 22.
Figure 29:
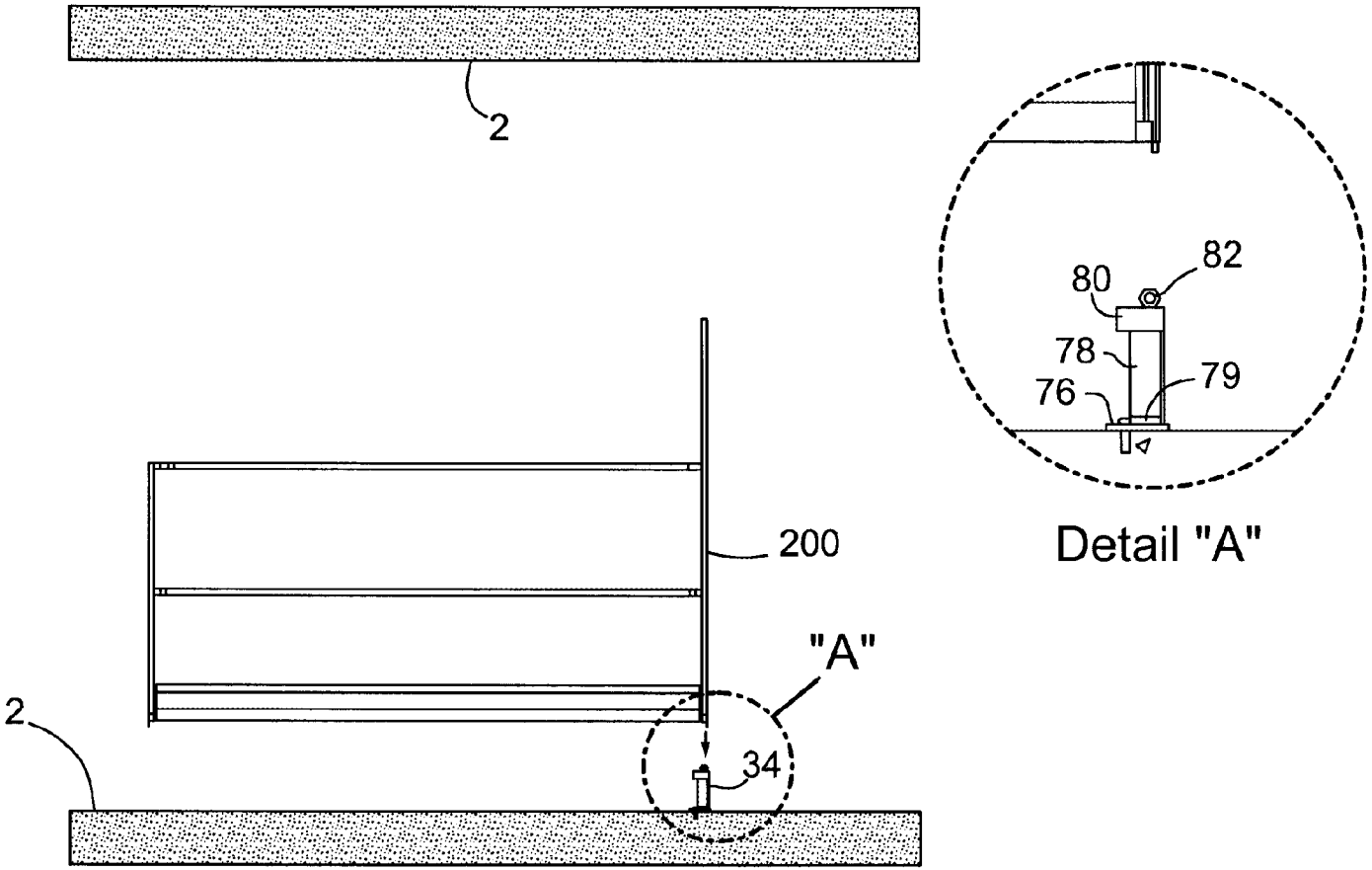
FIG. 29 is a side elevational view of the sleeve or foot shown in FIG. 27 showing a collapsible safety barrier about to be engaged therewith.
Figure 30:
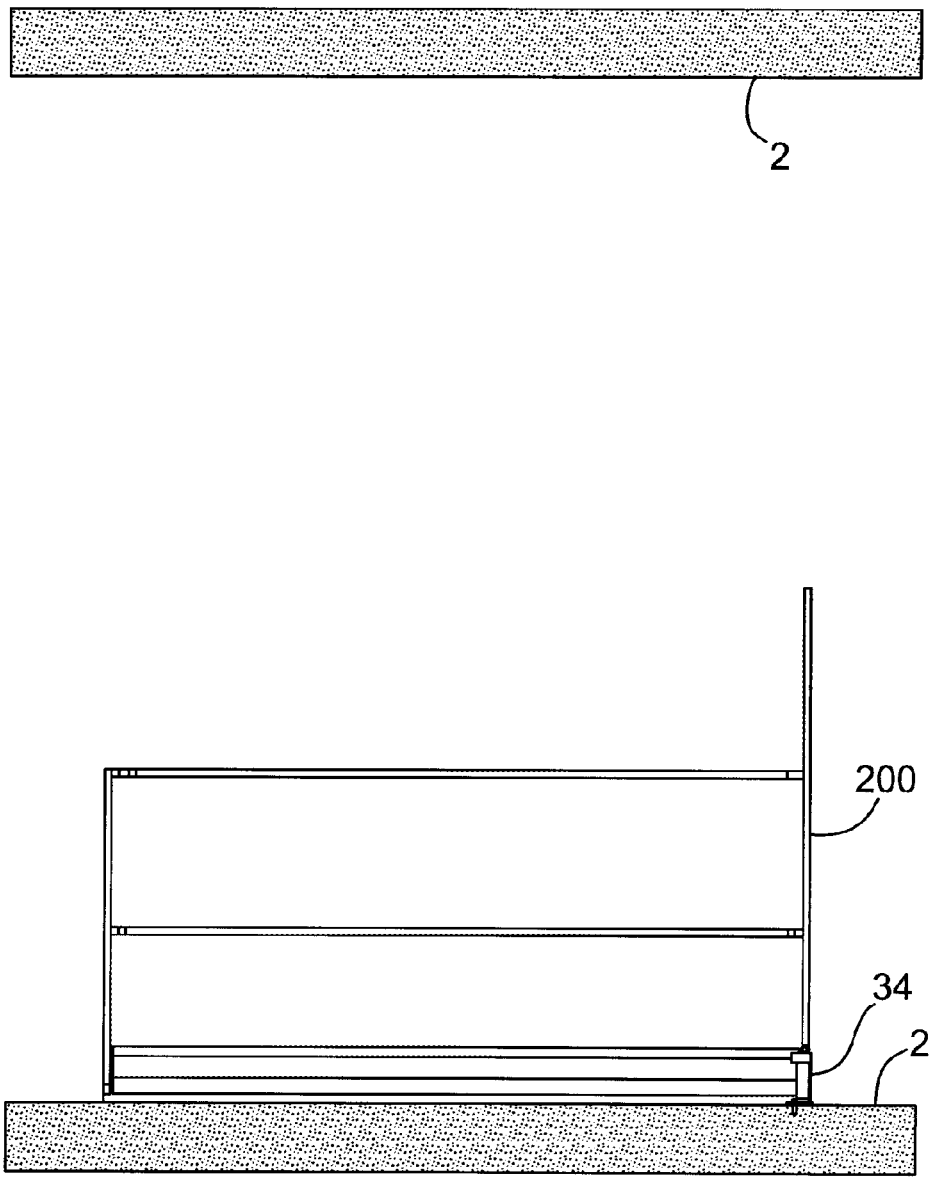
FIG. 30 is a view similar to FIG. 29 wherein the collapsible safety barrier has been received within the sleeve or foot.
Figure 31:
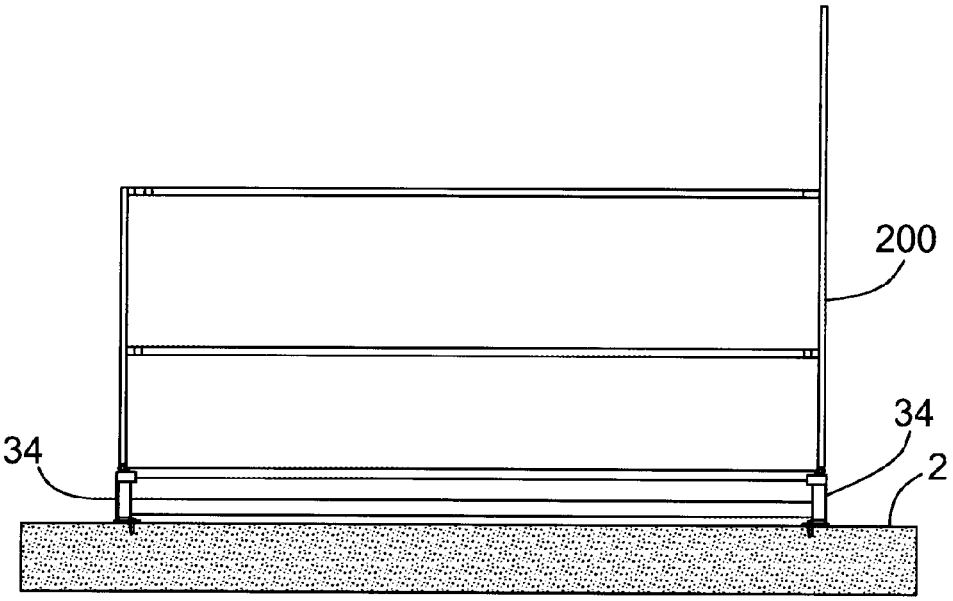
FIG. 31 is a view similar to FIG. 30 wherein a sleeve or foot is shown securing both ends of the collapsible safety barrier.

With specific reference to FIGS. 27 and 28, in one embodiment post clamp 80 is comprised of return 81 and side surfaces 86, 87 and 88. Here the post clamp is discontinuous about the exterior surface of a post received therein, with the clamp effectively having an opening or gap 85 (as shown most particularly in FIG. 28). In this manner the end post may be received within the interior of clamp 80 through inserting the lower portion of the post through gap 85. When the end post is so inserted and retained in place by bolt 83, horizontal load applied to the end post will be accommodated by one or more of side surfaces 86, 87 and 88 and/or by return 81.

Figure 32:
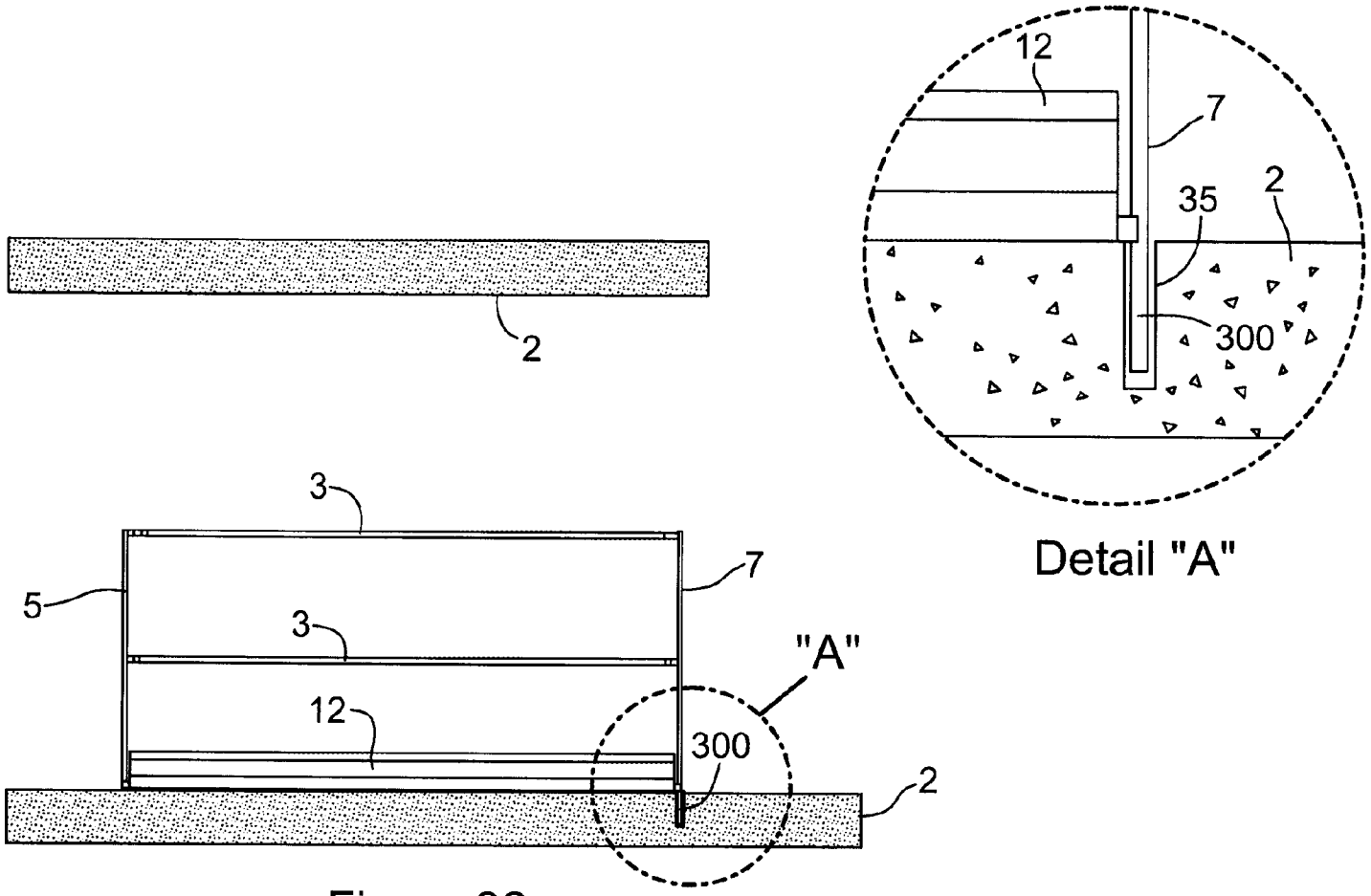
FIG. 32 shows yet a further alternate embodiment of the invention.
Figure 33:
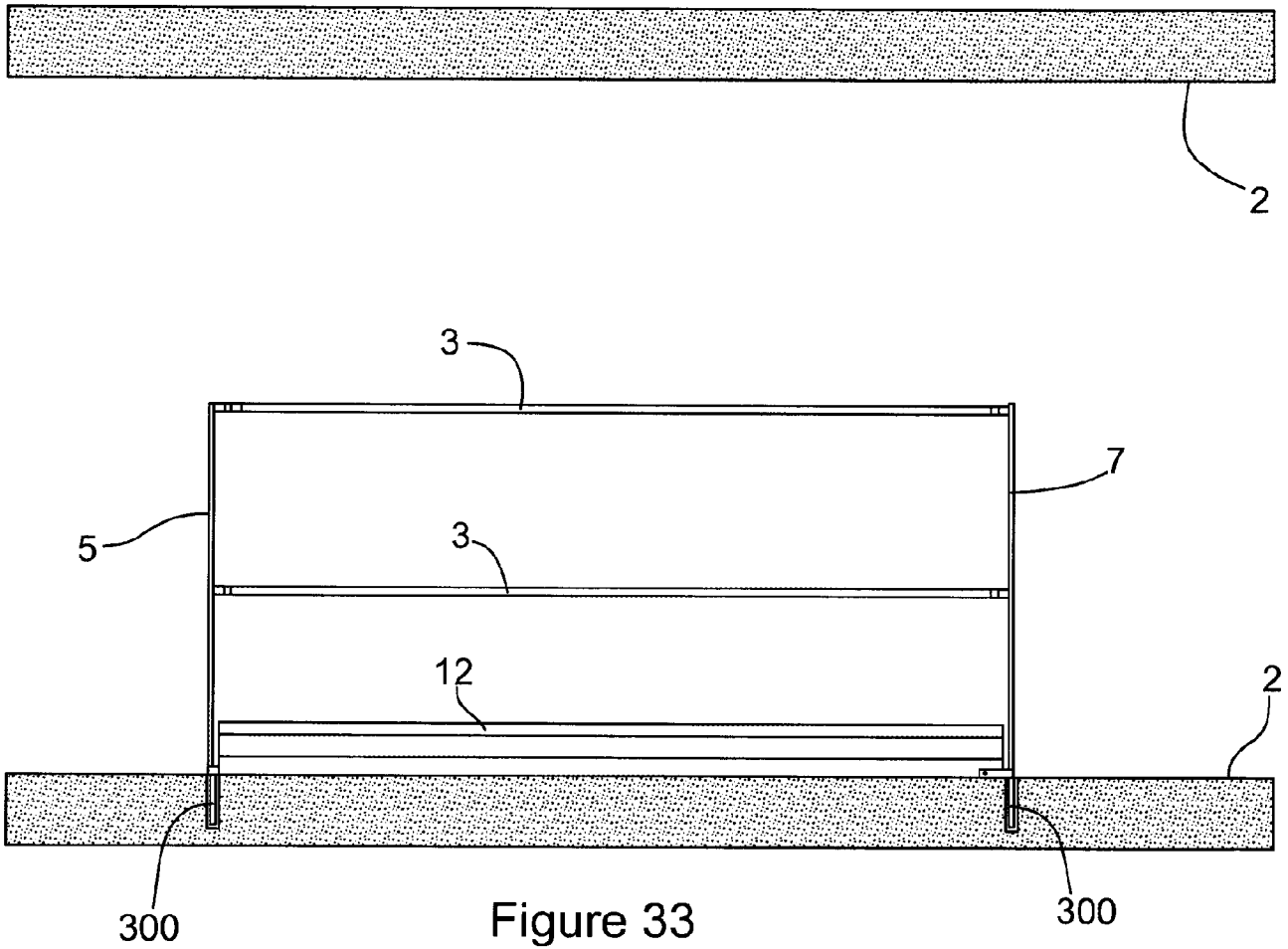
FIG. 33 shows an alternate embodiment of the invention shown in FIG. 32.

Further embodiments of the invention are shown in FIGS. 32 through 37. In the case of FIG. 32, there is depicted a collapsible safety barrier comprised of a plurality of longitudinal rails 3 hingedly secured to a first end post 5 and a second end post 7. Whereas in the case of a traditional section of a safety barrier or fence, where the lower ends of the two end posts are aligned (and generally at the same level or elevation as the lower-most longitudinal rail, in the embodiment of FIG. 32 one of the end posts has a lower end that extends significantly beyond that of the other end post. In the particular embodiment depicted in FIG. 32, it is the lower end 300 of second end post 7 that is elongated. Here, in application, the floor structure 2 has incorporated into it a sleeve 35 where the upper end of the sleeve terminates at the upper surface of the floor (in contrast to that shown in FIG. 21). Through manufacturing portion 300 of end post 7 and sleeve 35 such that they have cooperating relative exterior and interior dimensions, portion 300 will be receivable within sleeve 35 to thereby allow the safety barrier to be mounted upon the floor structure. It will thus be appreciated by those of skill in the art having a thorough understanding of the invention, that in so doing end post 7 will be held in a generally vertical orientation, preventing a folding or collapsing of the safety barrier, while at the same time permitting the barrier to accept a horizontal load. As mentioned previously, one of ordinary skill will also appreciate that if desired, rather than utilizing a sleeve 35, it would be possible to merely drill or bore a hole into the floor structure within which end or portion 300 of post 7 can be received. FIG. 33 shows a slightly alternate embodiment of the invention to that shown in FIG. 32 wherein each of end posts 5 and 7 have an extended or elongated lower portion 300 that is received within either a sleeve 35 within the floor structure or a bore or other cooperatively dimensioned opening.

Figure 35:
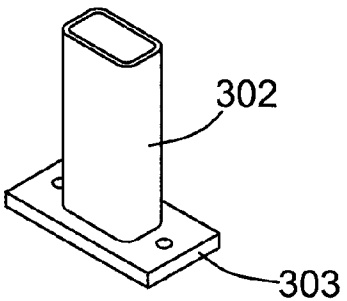
FIG. 35 is an enlarged upper perspective view of the foot or base of FIG. 34.
Figure 34:
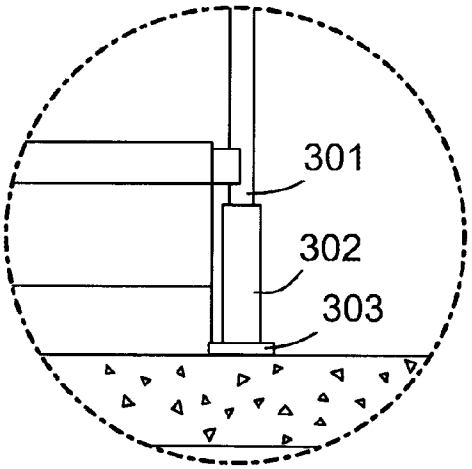
FIG. 34 shows still a further embodiment of the invention.
Figure 34:
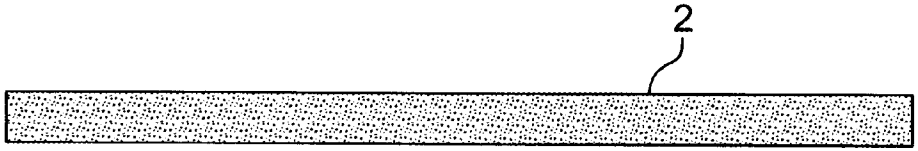
Figure 34:
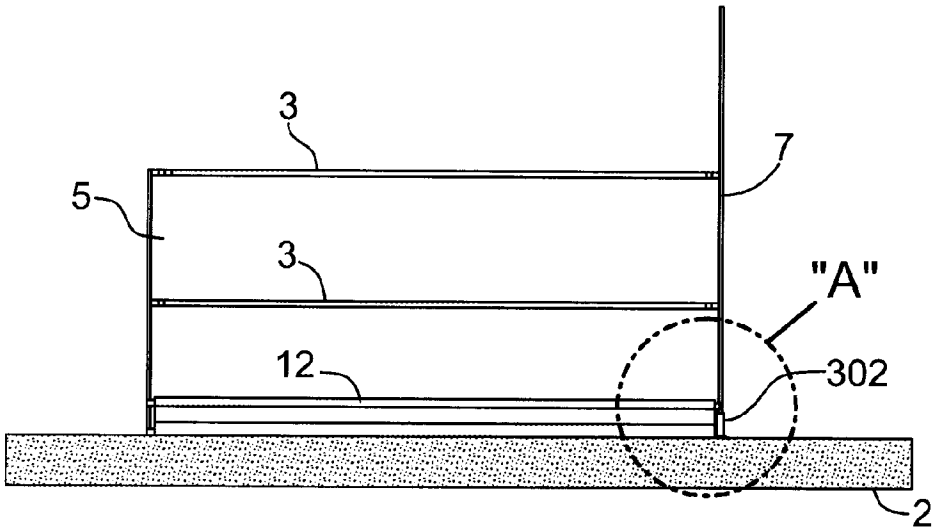

FIGS. 34, 34A and 35 depict an embodiment of the invention wherein the lower portion 301 of end post 7 is received within a sleeve or foot 302 having a flange or base 303 which is securable to the floor structure through the use of fasteners, adhesives, etc. In this embodiment sleeve or foot 302 is similar in structure to that shown in FIG. 22, however, the sleeve does not include a channel 77 as in the case of that depicted in FIG. 22. In FIGS. 34, 34A and 35 sleeve or foot 302 receives the lower end 301 of post 7 to thereby mount the safety barrier to the floor structure, prevent a collapsing or folding of the safety barrier and to accommodate horizontal loading.

Figure 36:
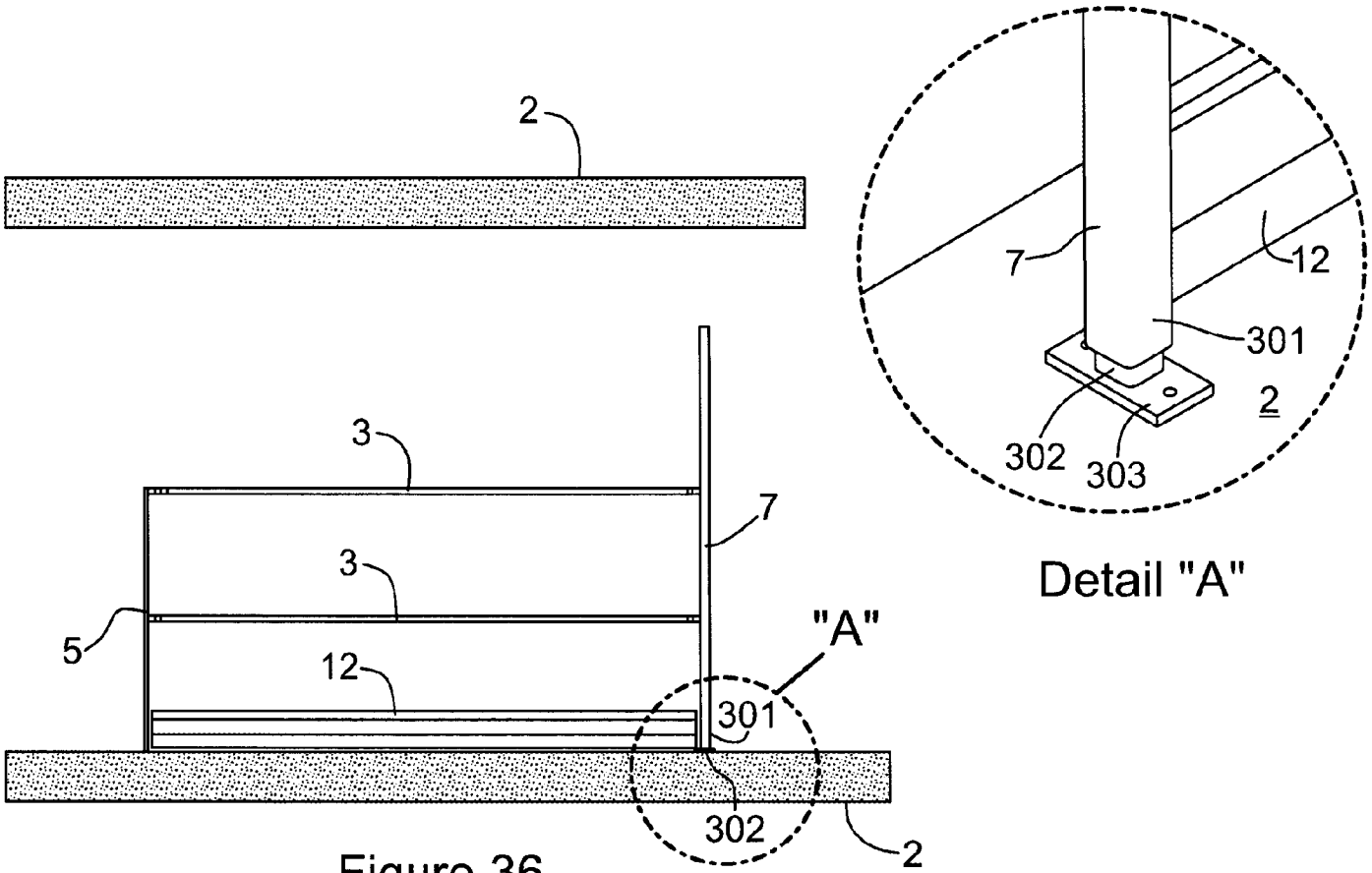
FIG. 36 is an alternate view of the embodiment shown in FIG. 34.

FIGS. 36 and 36A show an embodiment similar to that of FIGS. 34, 34A and 35, however, in this instance the lower end or portion 301 of post 7 is received over a supporting member of sleeve or foot 302. Aside from that difference, the embodiment of FIGS. 36 and 36A essentially function the same as that shown in FIGS. 34, 34A and 35. One of ordinary skill in the art will thus appreciate that the embodiment of FIGS. 36 and 36A will thus allow for the prevention of a folding or collapsing of the safety barrier when portion 301 is received over sleeve or foot 302, while at the same time accommodating horizontal loading.

Figure 37:
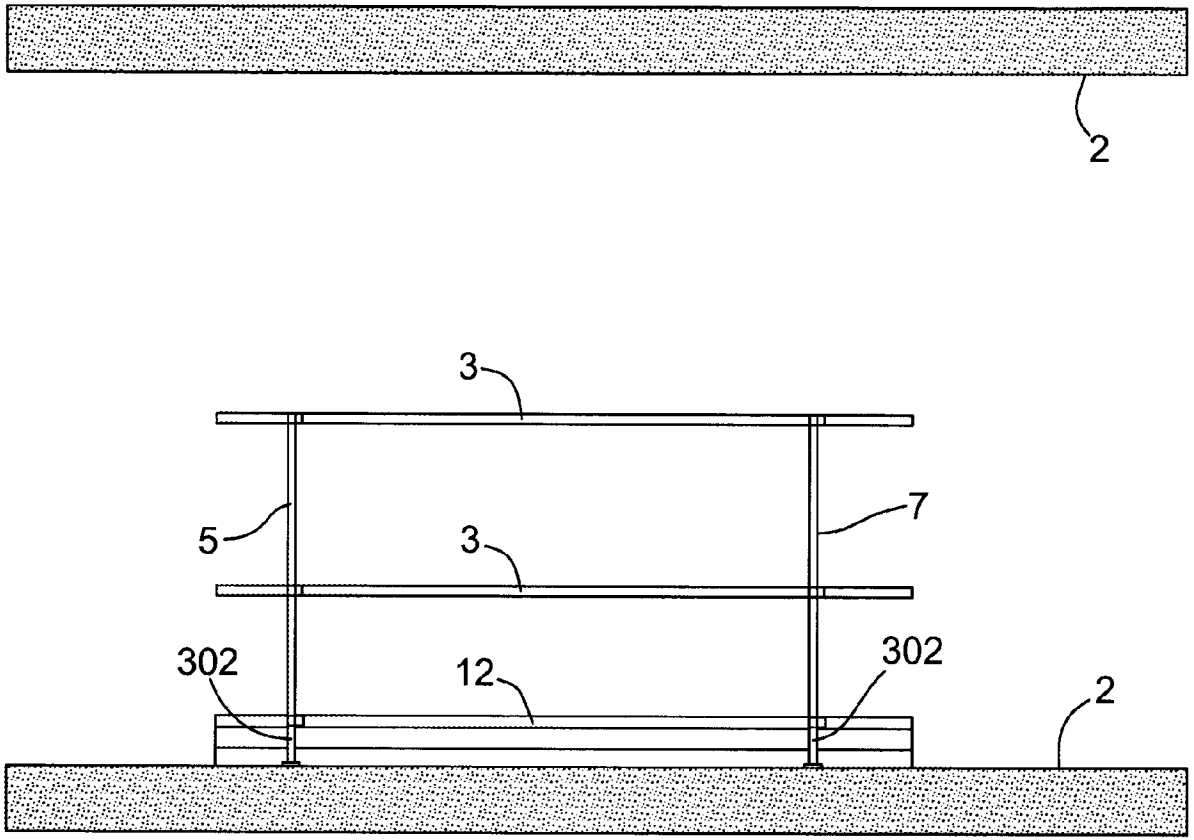
FIG. 37 is yet a further alternate embodiment of the invention.

FIG. 37 depicts an embodiment of the invention wherein longitudinal rails 3 and kick plate 12 are hingedly secured to first and second end posts 5 and 7 at a position inwardly offset from the outer ends of the longitudinal rails and the kick plate. In this particular instance the safety barrier is shown to be secured to floor 2 through the use of a sleeve or foot 302 associated with the lower portion of each of end posts 5 and 7. It will nevertheless be appreciated that any one of the previously described structures that may be employed (as well as other conceivable structures) to mount or secure the safety barrier to the floor structure could be utilized. In the case of the embodiment shown in FIG. 37, the safety barrier will still permit a folding or collapsing when not secured to the floor structure in order to facilitate a simplified transport and storage of the barrier when not required or not in use. Further, when in its deployed configuration and mounted to the floor structure, one of skill in the art will appreciate that the safety barrier of FIG. 37 will accommodate horizontal loading and provide protection to individuals and equipment. The degree or amount of the set-off of end posts 5 and 7 from the outer ends of the longitudinal rails and the kick plate will be a function of the amount of horizontal load required to be accommodated, the material from which the rails and posts are constructed, and the physical structure and configuration of the longitudinal rails and the end posts. It will be understood that FIG. 37 merely demonstrates that the collapsible safety barrier may not be specifically constructed with end posts 5 and 7 secured directly to the outer ends of the longitudinal rails and the kick plate.

Where device 1 includes an extension rail 8, it will further include a latching mechanism 11 that secures extension rail 8 to second end post 7. In this particular embodiment the latching mechanism generally secures the bottom or lower portion of the extension rail to second end post 7. Latching mechanism 11 has an engaged position where it both secures the extension rail to the second end post and also resists relative longitudinal movement between the two components. Further, latching mechanism 11 has a disengaged position where it permits relative longitudinal movement between the extension rail and the second end post. It will thus be appreciated that through the engagement and disengagement of latching mechanism 11 extension rail 8 can be moved longitudinally relative to second end post 7 until such time as ceiling engaging means 10 contacts the ceiling structure, while at the same time floor engaging means 9 is in contact with the floor structure. Engaging the latching mechanism at that point will thus restrict the longitudinal movement of the extension rail relative to the second end post, tending to secure the components between the floor and ceiling structures. An embodiment of latching mechanism 11 is discussed in more detail below and shown in FIGS. 9*a*-9*c*.

Second end post 7 and extension rail 8 thus together function overall similarly to a standard or more traditional support post that is used in such applications. In most applications, second end post 7 and extension rail 8, when engaging the floor and ceiling structures, will be in a generally vertical plane, the result of which will be to cause longitudinal rails 3 to be oriented generally horizontally and first end post 5 to be oriented generally vertically. In the embodiment depicted in the attached drawings, device 1 is shown as including a longitudinal kick plate 12 that is hingedly secured to at least one of the end posts, and that in this configuration (for example see FIG. 2*a*) is also generally horizontally oriented.

Figure 3:
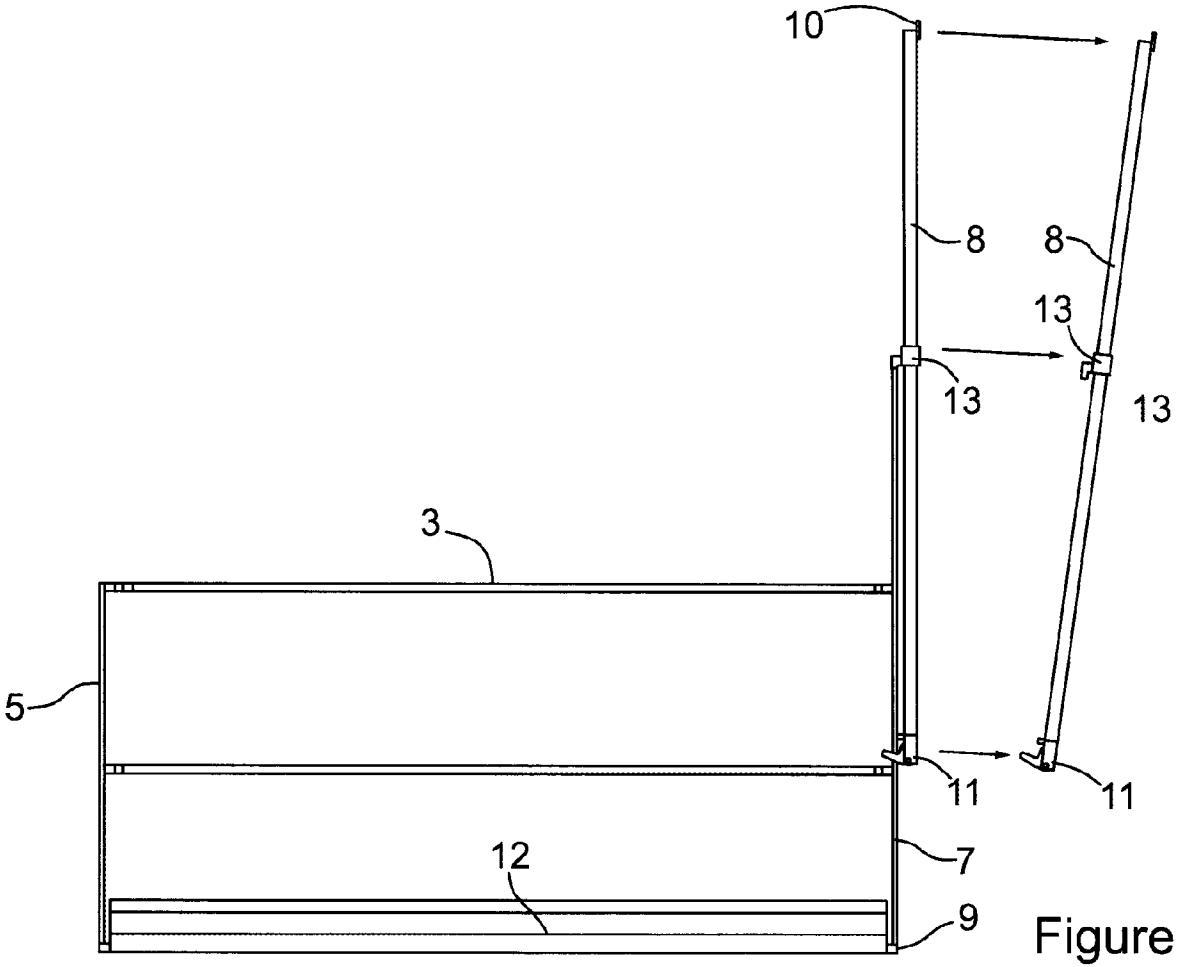
FIG. 3 is a view of the safety barrier and support post shown in FIG. 2 wherein the extension rail is in a retraced position.
Figure 7:
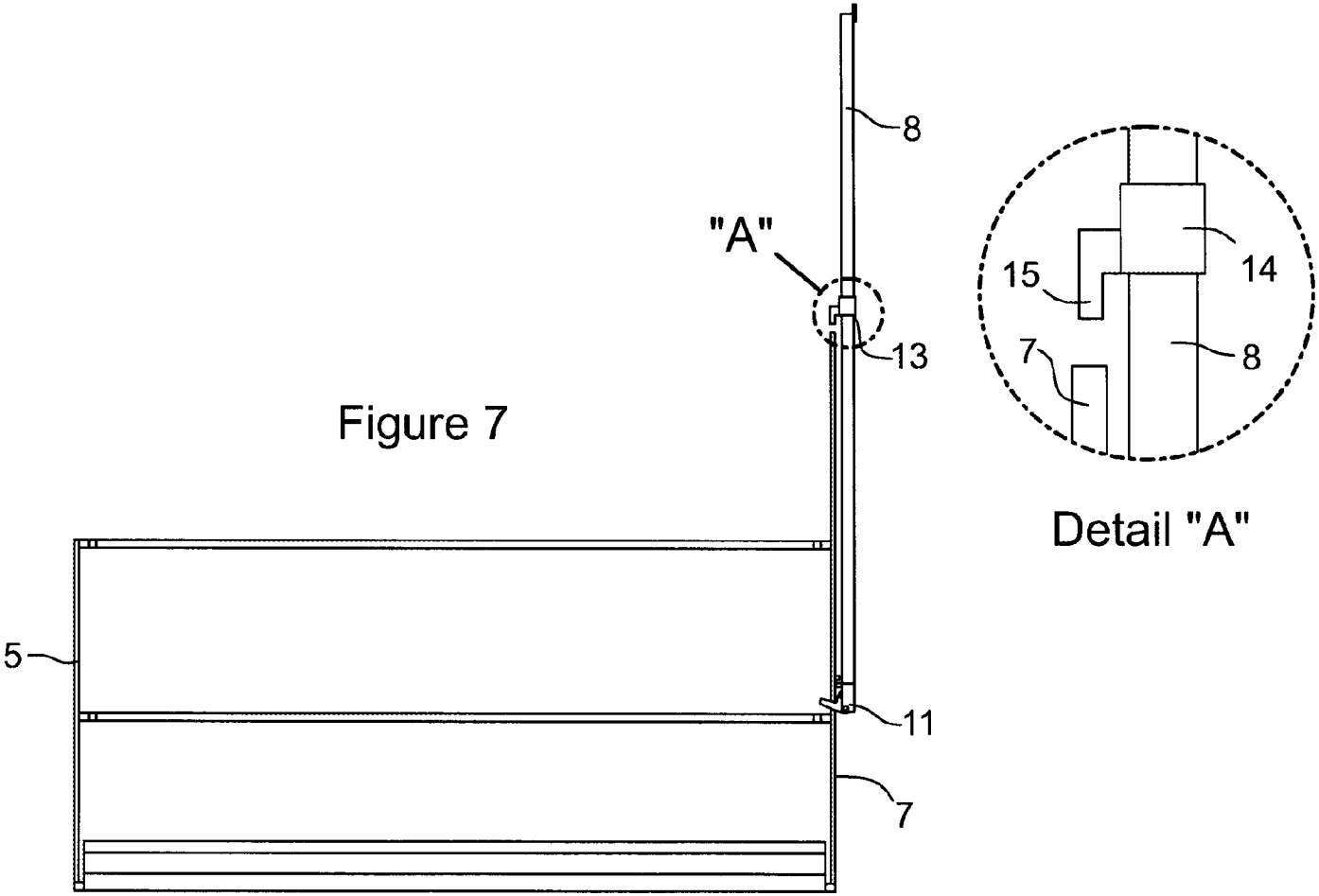
FIG. 7 is a side view of the safety barrier and support post of FIG. 3 wherein the extension rail clamp has been decoupled from the second end post.
Figure 8:
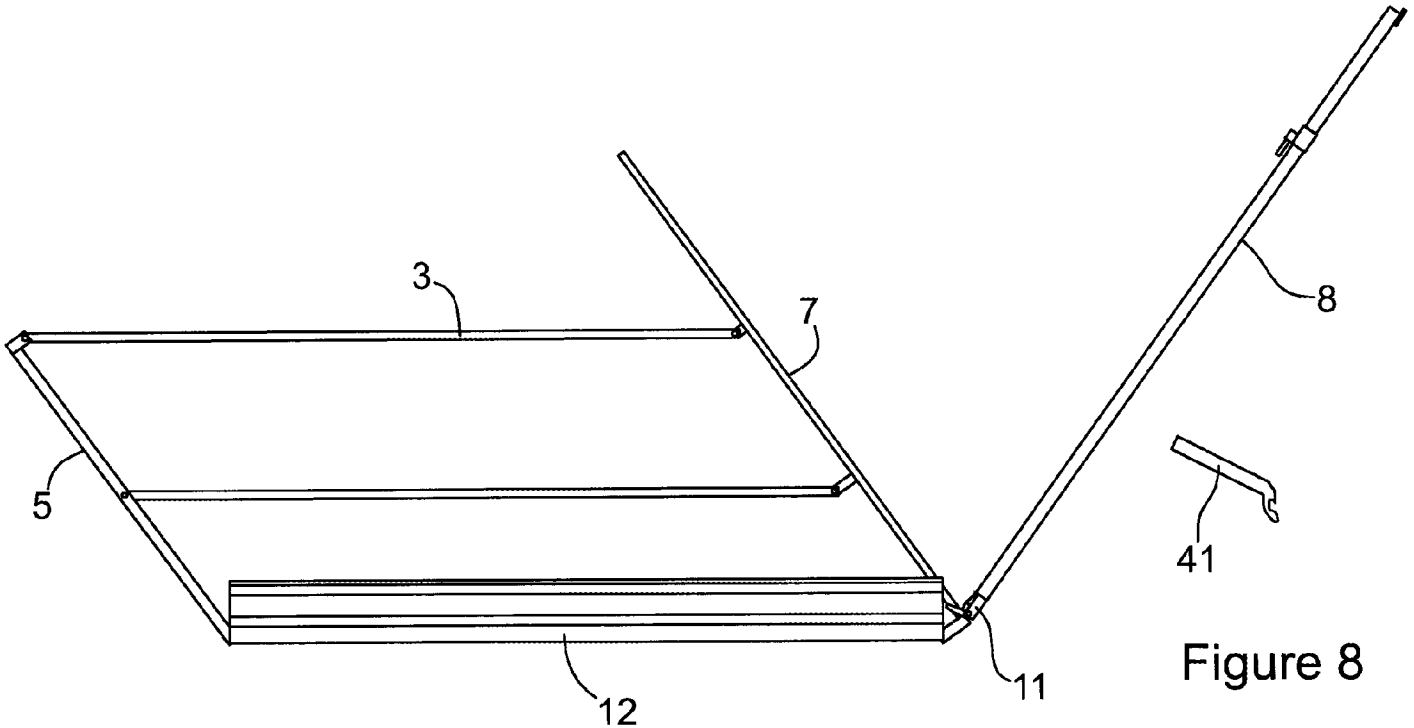
FIG. 8 is a side perspective view of the safety barrier and support post shown in FIG. 7 wherein the upper end of the extension rail has been rotated away from the second end post in order to activate the latching mechanism.

With particular reference to FIGS. 2*a*, 3 and 7, device 1 includes an extension rail clamp 13 to releasably secure extension rail 8 to second end post 7. In this embodiment clamp 13 is used to secure the extension rail to the top or upper portion of the second end post and also restricts relative lateral movement between the top of the second end post and the extension rail. From a thorough understanding of the invention it will be appreciated that extension rail clamp 13 could take any one of a very wide variety of different physical structures (for example, but not limited to, a nut, a bolt, a pin, etc.). The function of the extension rail clamp is to both permit the relative longitudinal movement of the extension rail and the second end post, while at the same time preventing or restricting lateral movement between at least the top of the second end post and the extension rail. In the embodiment shown, extension rail clamp 13 slidably engages both the extension rail and the second end post. Here the extension rail clamp has a first generally tubular section 14 that is slidably received over the exterior of extension rail 8. Clamp 13 also has a male end 15 that is receivable within the hollow upper end of second end post 7. FIG. 3 shows male end 15 received within the hollow upper end of the second end post such that lateral movement between the support post and the extension rail is restricted. In FIG. 7 (and in particular "Detail A" of FIG. 7), extension rail clamp 13 is shown as having been slid upwardly along the extension rail such that male end 15 is no longer engaged within the hollow interior of second end post 7, thereby no longer preventing lateral movement between the extension rail and the second end post. FIG. 3 also demonstrates how extension rail 8 may be removed from its engagement with second end post 7 for transportation purposes, for replacement, or servicing if necessary.

Figure 4:
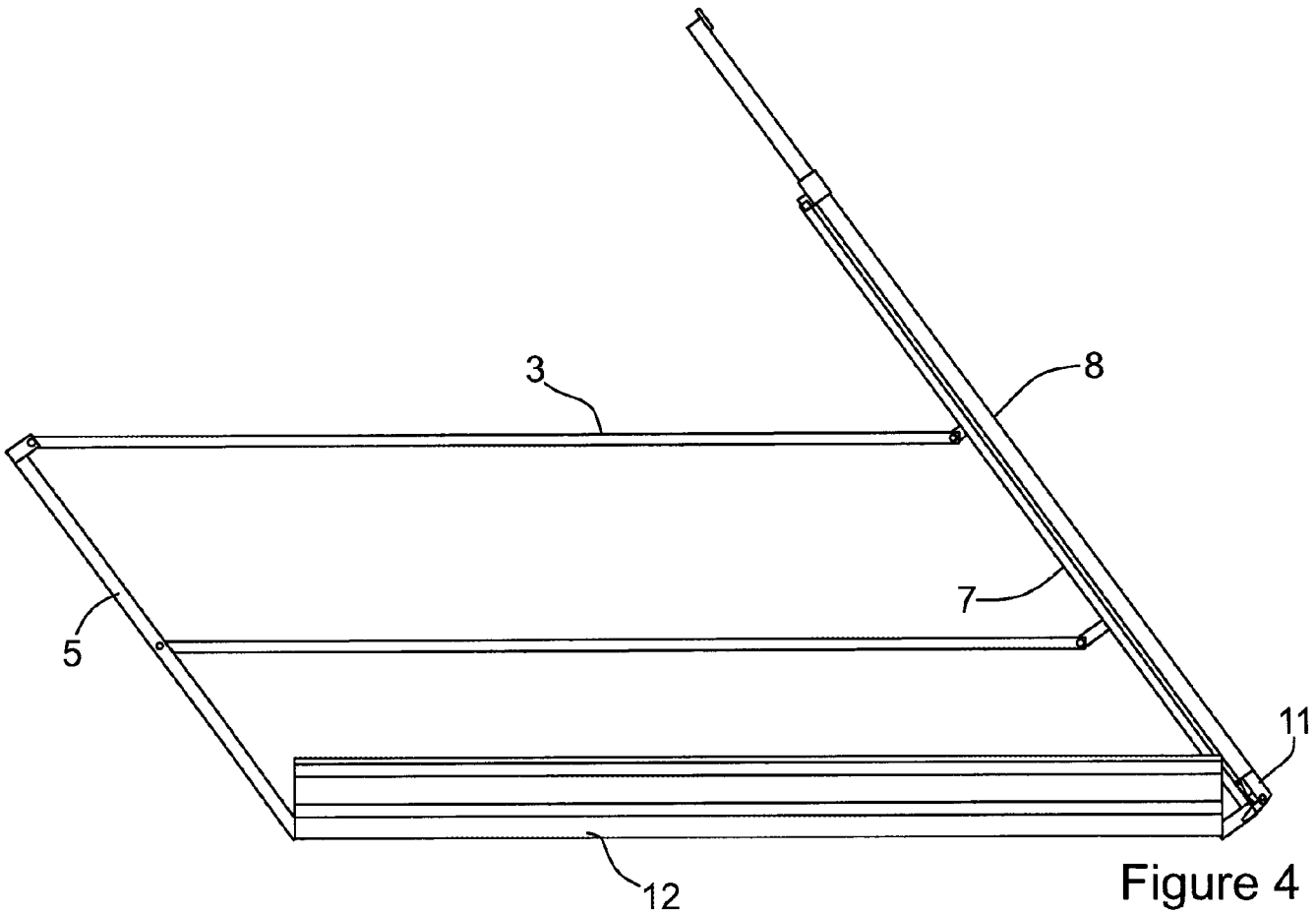
FIG. 4 is a view of the safety barrier and support post shown in FIG. 3 in a partially folded or partially collapsed position.

It will thus be understood that with floor and ceiling engaging means 9 and 10 engaging the respective floor and ceiling surfaces, with male end 15 of extension rail clamp 13 received within the hollow upper end of the second end post 7, and with latching mechanism 11 in its engaged position, the collapsible safety barrier and support post will be in a deployed position and held in a generally vertical plane between the floor and ceiling structures, with the longitudinal rails being generally horizontal and generally perpendicular to the first and second end posts (see FIG. 2*a*). It will further be appreciated that when latching mechanism 11 is in it disengaged position, ceiling engaging means 10 may be retracted from the ceiling structure to permit device 1 to be moved to a collapsed position. The hinged engagement of the longitudinal rails with the respective first and second end posts will permit the structure to be collapsed, with the first and second end posts, the longitudinal rails, and the extension rail positioned generally parallel and adjacent to one another. FIG. 4 depicts the structure in a partially collapsed position, whereas FIGS. 5 and 6 show the structure in a fully collapsed position. Device 1 may further include a handle 36 (which may be a removable handle) to facilitate the lifting and movement of the device when in its collapsed position.

Those of ordinary skill in the art will appreciate that in such applications a support post must be securely and rigidly held between the floor and ceiling structures. As mentioned, in some cases the upper and low ends of the support post may be secured to the floor and ceiling structures through use of mechanical or other fasteners. However, in many instances the posts are tensioned between the floor and ceiling, effectively driving the floor and ceiling engaging means into their respective floor and ceiling structures to the point where the post is capable of accepting a required degree of horizontal loading.

In the particular embodiment of the device shown in FIGS. 1 through 19, the support post is tensioned in place between the floor and ceiling structures. It will be appreciated that many different mechanisms could be utilized to effectively drive the floor and ceiling engaging means into the floor and ceiling structures while remaining within the broad scope of the invention. The most common methods for "activating" a support post are through use of a ratchet type structure or a spring mechanism. In the case of the embodiment shown, the post is spring activated. In that regard extension rail 8 includes an upper and a lower extension tube (17 and 18 respectively) with lower extension tube 18 telescopically received within upper extension tube 17. Further, latching mechanism 11 includes a clamping foot 19 that is hingedly secured at or near the lower-most end of lower extension tube 18. Clamping foot 19 includes a gripping ring 20 that is received about at least a portion of the exterior of second end post 7 and that is permitted to slide upwardly and downwardly along at least a portion of the end post. Ring 20 may be continuous or discontinuous around the circumference or exterior surface of second end post 7. Where the ring is discontinuous, a slot in the ring permits the ring to slide along the length of the second end post 7 without interfering with longitudinal rails 3. Gripping ring 20 includes one or more gripping teeth or gripping surfaces that can be caused to frictionally contact the exterior surface of second end post 7 to securely hold the clamping foot to the post when latching mechanism 11 is in its engaged position.

Figures 9A, 9B, 9C:
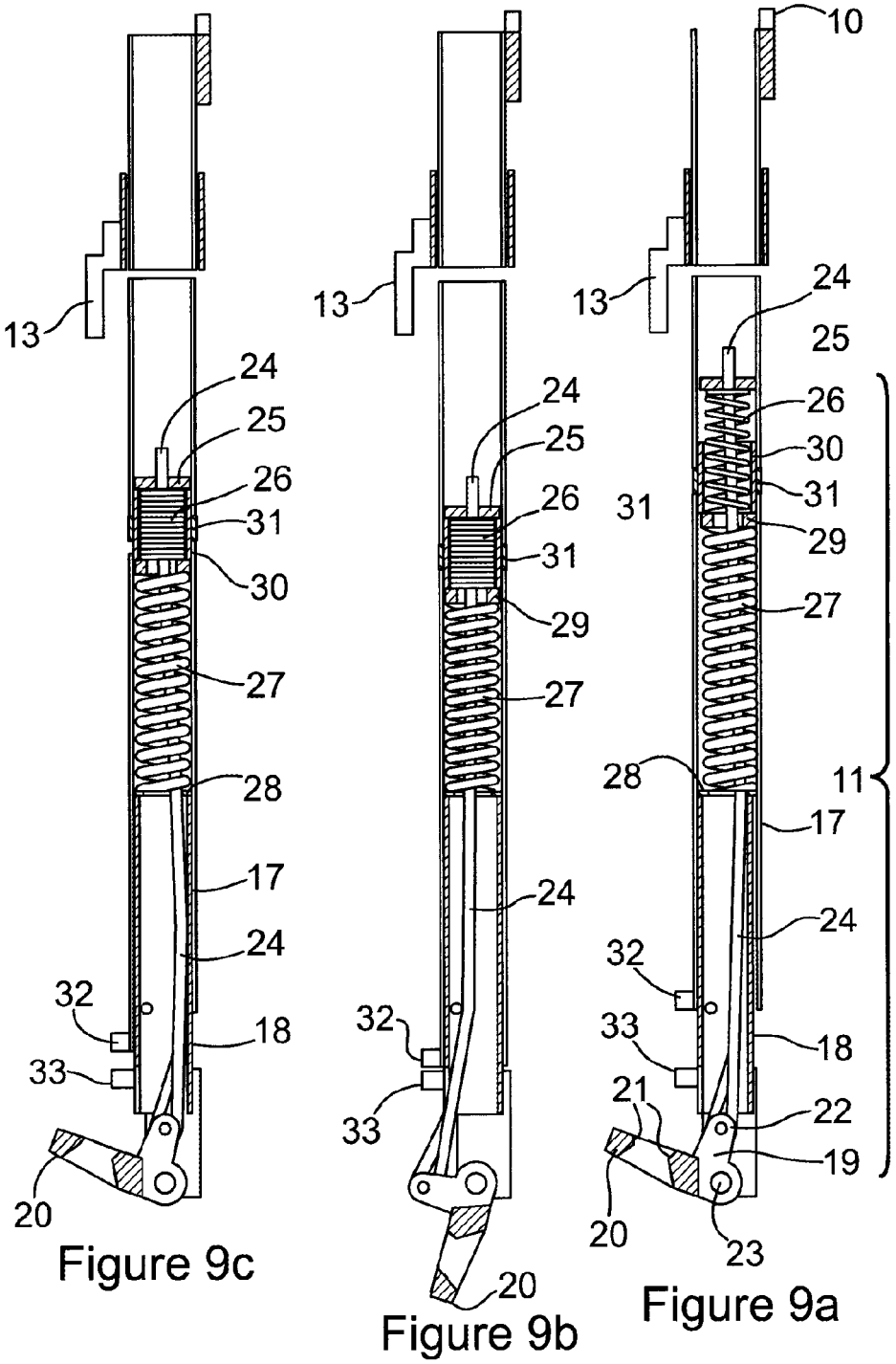
FIG. 9*a* is a side sectional view vertically through the extension rail of FIG. 7 wherein the latching mechanism is in a disengaged position.
FIG. 9*b* is a view similar to FIG. 9*a* wherein the latching mechanism is in a cocked position.
FIG. 9*c* is a side sectional view similar to FIG. 9*b* wherein the latching mechanism is in an engaged position.

With specific reference to FIGS. 9*a* through 9*c*, it will be noted that in the embodiment shown, clamping foot 19 further includes an arm 22 that is generally perpendicular to gripping ring 20. Clamping foot 19 is hingedly secured to lower extension tube 18 through the use of a bolt or pin 23 and in a configuration such that the gripping ring is oriented outwardly from lower extension tube 18 and receivable about at least a portion of the exterior surface of second end post 7, with arm 19 oriented generally along the longitudinal axis of extension rail 8 when latching mechanism is in its disengaged position. Attached to arm 22 is an activation rod 24. Activation rod 24 extends upwardly through lower extension tube 18 and into upper extension tube 17, and has at its upper end a fixed spring support 25 rigidly secured thereto. Positioned within upper extension tube 17 and about activation rod 14 is an upper spring 26 and a lower spring 27. As will be appreciated from an understanding of the description that follows, lower spring 27 is the primary means by which the support post is tensioned and the floor and ceiling engaging means driven into contact with the floor and ceiling structure. The primary function of upper spring 26 is to aid in the engagement and disengagement of the latching mechanism, with the spring biasing the latching mechanism towards its disengaged position.

FIG. 9*a* shows latching mechanism 11 in its disengaged position. Here, neither upper spring 26, nor lower spring 27, is in a compressed configuration. The lower end of lower spring 27 bears against a support washer 28 that in turn sits on top of lower extension tube 18. The upper end of lower spring 27 bears against an upper support washer 29, which in turn bears against a cylinder 30 that is rigidly secured to upper extension tube 17 through the use of pins 31. In this manner, with lower spring 27 in a generally uncompressed state, there is no significant force tending to drive the upper and lower extension tubes longitudinally apart. FIG. 9*a* also shows upper spring 26 in a generally non-compressed state and positioned between upper spring support 25 and the upper surface of upper support washer 29. In this configuration upper spring 26 puts little force upon activation rod 24 and permits clamping foot 19 to be easily rotated about pin 23. Spring 26 does, however, tend to keep gripping ring 20 tilted slightly upwardly. It will thus be appreciated that in this configuration of the upper and lower springs, the clamping foot can be manually grasped and held such that gripping teeth 21 do not impede the sliding of the clamping foot along the length of second end post 7.

With reference to FIG. 9*b*, latching mechanism 11 is shown in a cocked configuration. Here, extension rail clamp 13 has been disengaged from second post 7 and extension rail 8 has been pulled laterally away from second end post 7 such that gripping ring 19 engages the second end post causing the activation rod to be pulled downwardly through the extension rail as the rail is rotated away from second end post 7 (see also FIG. 8). As the activation rod is pulled downwardly both upper and lower springs 26 and 27 are compressed. A pair of locking tabs 32 and 33 (one on each of the upper and lower extension tubes) are brought together in a generally adjacent configuration as the activation rod effectively draws the upper extension tube over the lower extension tube.

With reference to FIGS. 11 through 14, latching mechanism 11 is shown including a rail lock 37 that is pivotally secured to lower extension tube 18. In this embodiment rail lock 37 is received about locking tab or locking pin 33 on the lower extension tube. FIGS. 11*a* and 11*b* show rail lock 37 in a disengaged configuration, such as would be the case when the latching mechanism is in the configuration shown in FIG. 9*a*. When the latching mechanism is moved to it cocked configuration as shown in FIG. 9*b* (and as described above) locking tabs 32 and 33 are brought together in an adjacent configuration such that rail lock 37 can be rotated causing rail lock 37 to also engage locking tab 32 on upper extension tube 17 (see FIGS. 12*a* and 12*b*). In the particular embodiment shown in the attached drawings, rail lock 37 includes a hook or bowl portion 38 that is received about locking tab 32 in order to hold the two locking tabs adjacent to one another. It will thus be appreciated when rail lock 37 is in an engaged condition lower spring 27 will be in its compressed state such that a latching mechanism is cocked. FIGS. 12*a* and 12*b* show rail lock 37 engaging both locking tabs 32 and 33 to retain the latching mechanism in its cocked configuration. In an alternate embodiment a firing tool (see FIG. 8) can be inserted about the locking tabs (rather than rail lock 37) to hold them together and thereby retain lower spring 27 in its compressed position (as it is in FIG. 9*b*). With latching mechanism 11 in its cocked condition, the extension rail 8 can then be rotated upwardly and back into a parallel configuration with second end post 7 so that extension rail clamp 13 can engage the end post and secure the extension rail to the post once again. At that point, the extension rail and second end post 7 will be secured together with lower spring 27 in a compressed or cocked configuration. Upper spring 26 will also be compressed. The extension rail is then slid upwardly along second end post 7 until ceiling engaging means 10 contacts the ceiling structure.

At this point rail lock 37 can be rotated such that it no longer engages upper locking tab 32, causing lower spring 27 to immediately "fire" upper extension tube 17 toward the ceiling structure and drive ceiling engaging means 10 into further contact with the ceiling. The rail lock can be rotated to disengage the upper locking tab through manually grasping the handle or outer portion 39 of the lock, or through inserting a screw driver, flat bar, or other tool into a slot 40 within handle or outer portion 39 in order to increase the amount of leverage that can be manually applied to the rail lock to rotate it to a disengaged configuration. In the embodiment shown in FIG. 13, a locking bar 43 is shown received within slot 40. In other embodiments the rail lock may include a more elaborate built-in locking handle. While lower spring 27 drives upper extension tube 17 upwardly, gripping teeth 21 on gripping ring 20 of clamping foot 19 engage the outer surface of second end post 7, to effectively prevent movement of the lower extension tube relative to second end post 7 placing the support post in tension with the ceiling engaging means driven into the ceiling and the floor engaging means driven into the floor. It will be appreciated that the spring constant of lower spring 27 and the amount of compression achieved through cocking locking mechanism 11 can be adjusted accordingly so as to provide a desired amount of force to be applied to the ceiling and floor engaging means in order to present a support post that is able to accommodate a side load in accordance with local workplace requirements or health and safety laws. It will also be appreciated that where a firing tool 41 (see FIG. 8) is utilized in place of rail lock 37, when the extension rail is slid upwardly along second post 7 until ceiling engaging means 10 contacts the ceiling structure the firing tool can be removed causing the lower spring to "fire" upper extension tube 17 towards the ceiling structure and to drive ceiling engaging means 10 into further contact with the ceiling.

It will further be appreciated that with the ceiling and floor engaging means driven into the ceiling and floor structures, with clamping foot 19 engaging the exterior surface of second end post 7, and with extension rail clamp 13 engaging both the extension rail and the upper end of second end post 7, the combination of the second end post and the extension rail will create a support post that is rigidly fixed between the ceiling and the floor structure. The support post will then provide a rigid support for the longitudinal rails and the first end post. A further collapsible safety barrier and support post can then be installed at either end of the first installed safety barrier and support post with adjacent first and second end posts wired, clipped or otherwise clamped together to form a continuous safety barrier of any desired length (for example see FIG. 1 wherein 3 such devices are secured together in an end to end relationship). In addition, it will be further appreciated that since longitudinal rails 3 and kick plate 12 are hingedly secured to the first and second end posts, the collapsible safety barrier and support post can be quickly and easily installed at an angle on stairwells, on sloped surfaces, etc. (see FIGS. 15, 16, 17) in order to present a safety barrier in such applications.

Figure 10A:
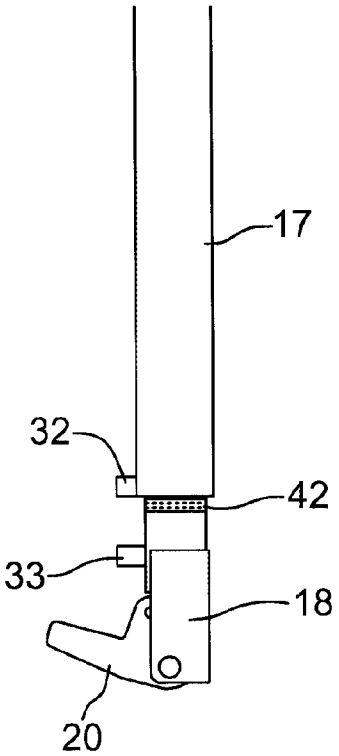
FIGS. 10*a* through 10*c* are drawings similar to FIG. 9*a* through 9*c* showing side elevational views of the extension rail and depicting the inspection gauge.
Figure 10B:
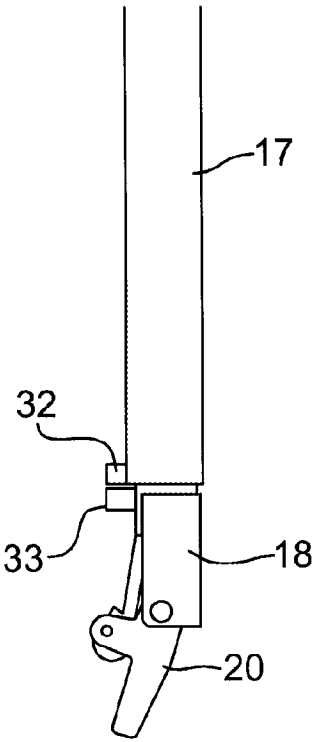
Figure 10C:
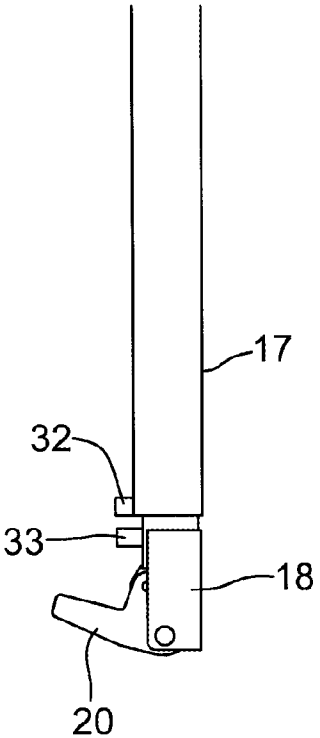
Figure 11B:
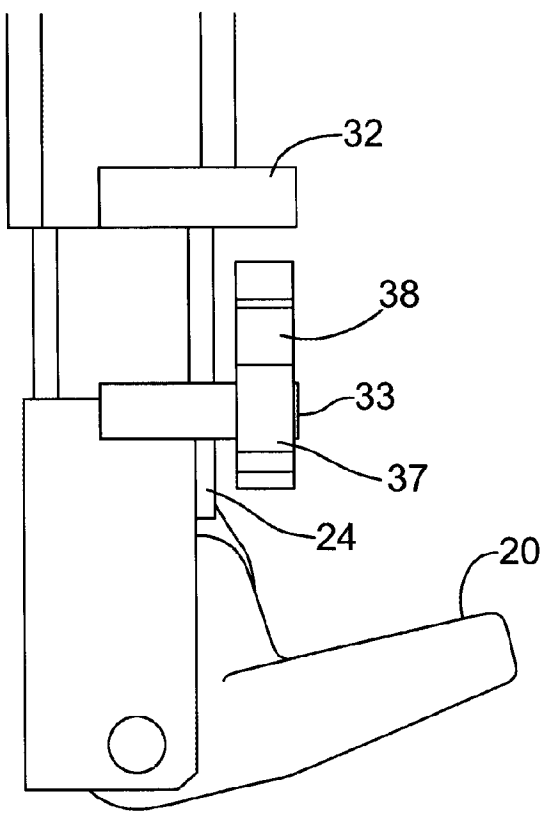
FIG. 11*b* is a left side view of the lower portion of the extension rail shown in FIG. 11*a*.
Figure 11A:
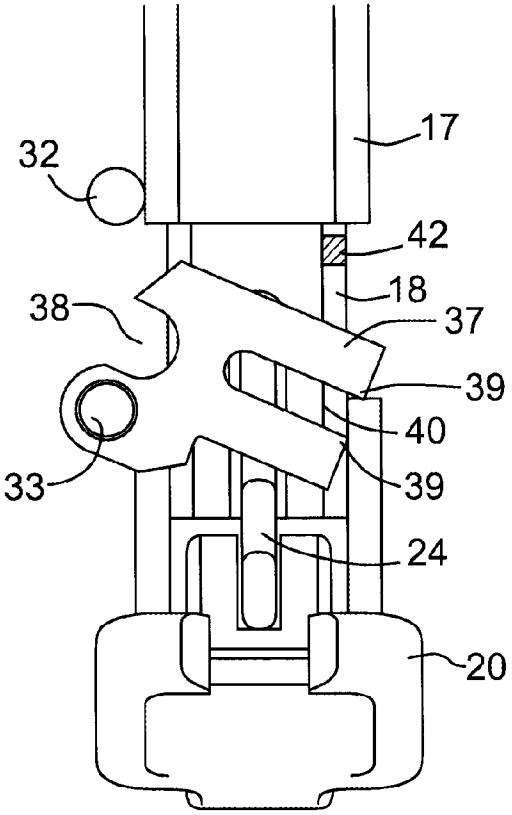
FIG. 11*a* is a side elevational view of the lower portion of the extension rail showing the rail lock in its disengaged position.
Figure 12B:
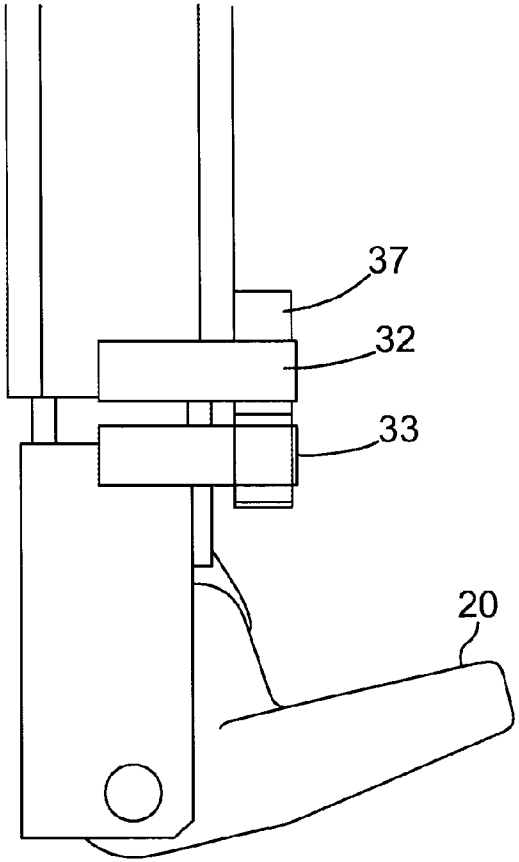
FIG. 12*b* is a left side elevational view of the lower portion of the extension rail shown in FIG. 12*a*.
Figure 12A:
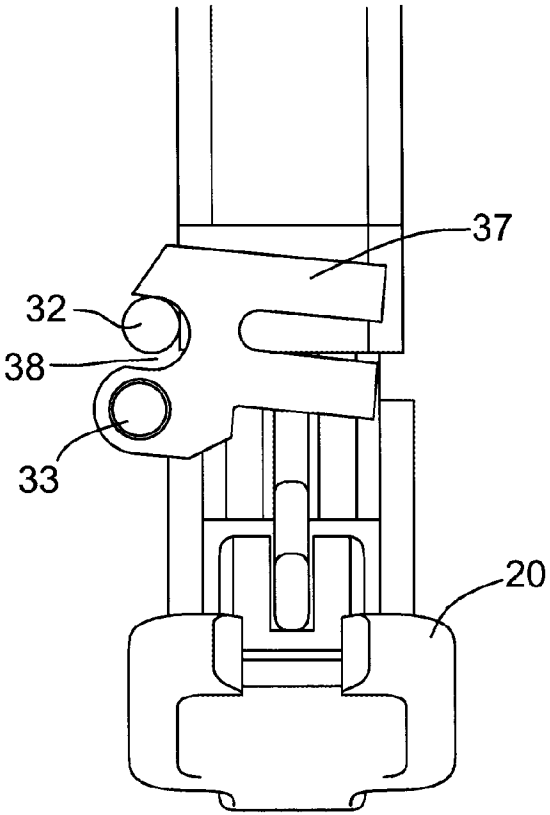
FIG. 12*a* is a side elevational view of the lower portion of the extension rail similar to FIG. 11*a* wherein the rail lock is in an engaged position.
Figure 14:
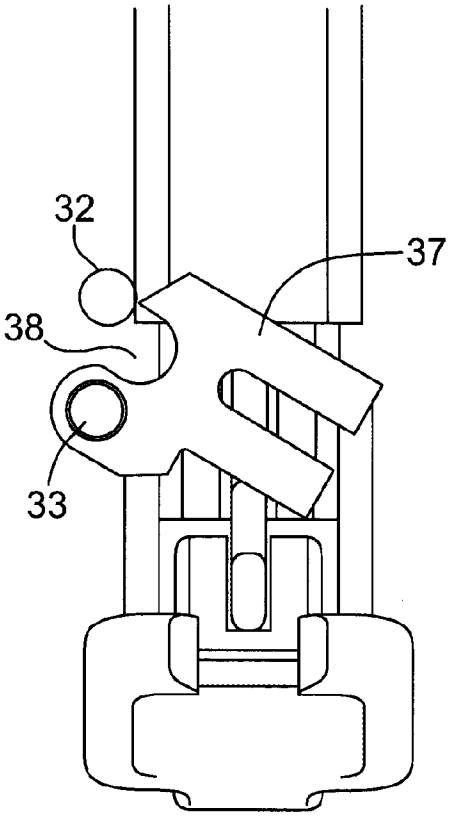
FIG. 14 is a view similar to FIG. 12*a* showing the rail lock immediately prior to being moved to its engaged position.
Figure 13:
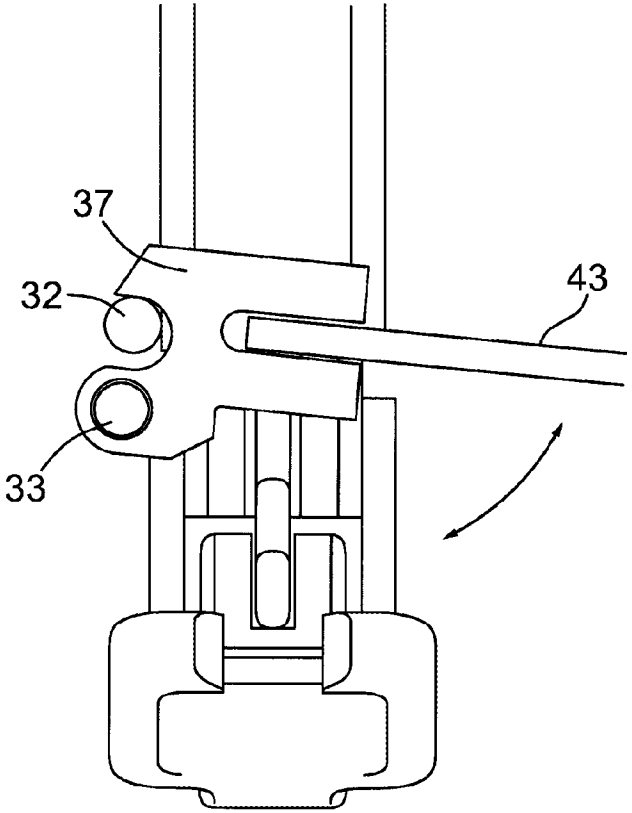
FIG. 13 is a view similar to FIG. 12*a* wherein the rail lock is shown as receiving a locking bar.
Figure 15:
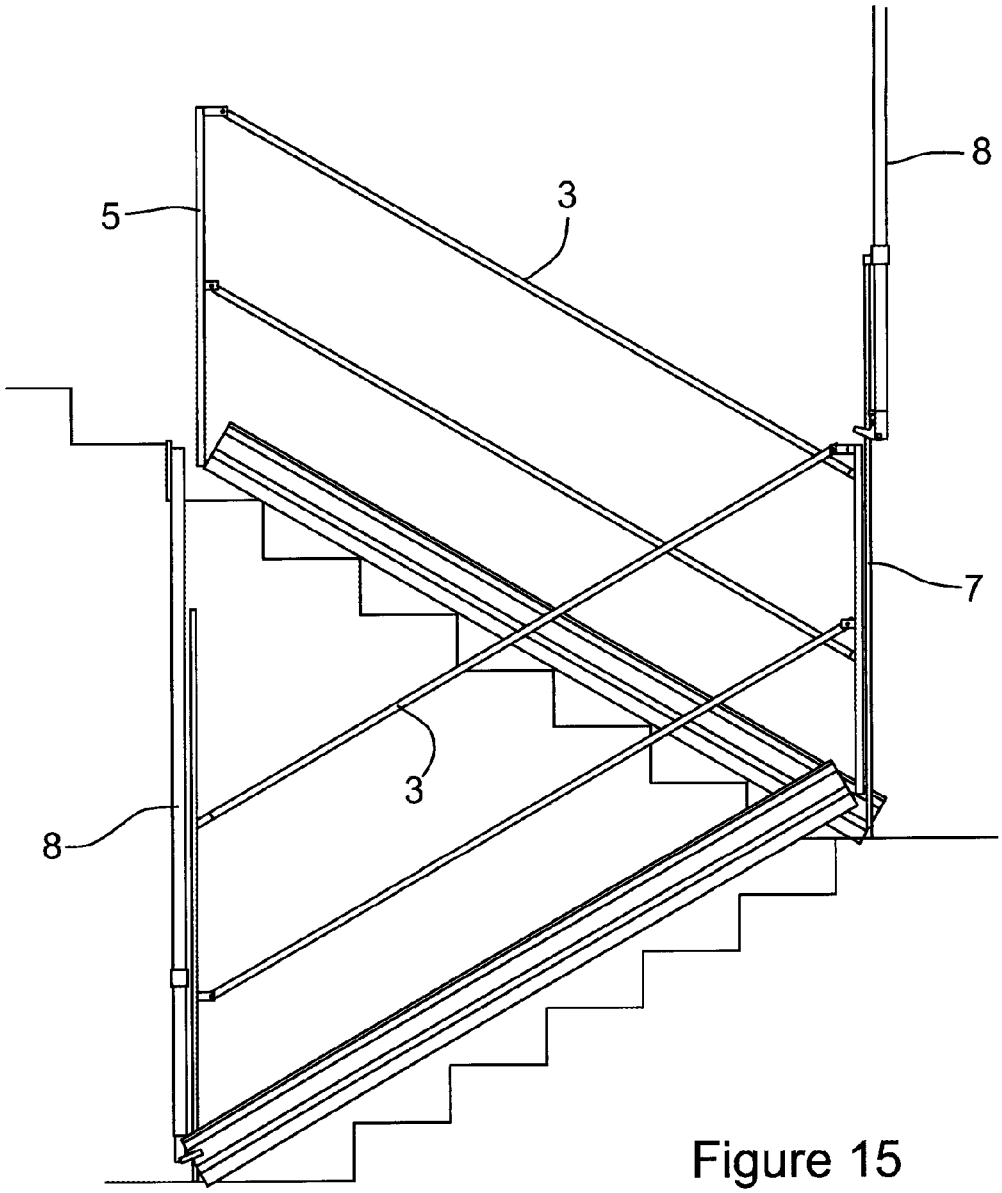
FIG. 15 is a side elevational view of a building stairwell showing the application of the collapsible safety barrier and support post in accordance with one of the embodiments of the present invention.
Figure 16:
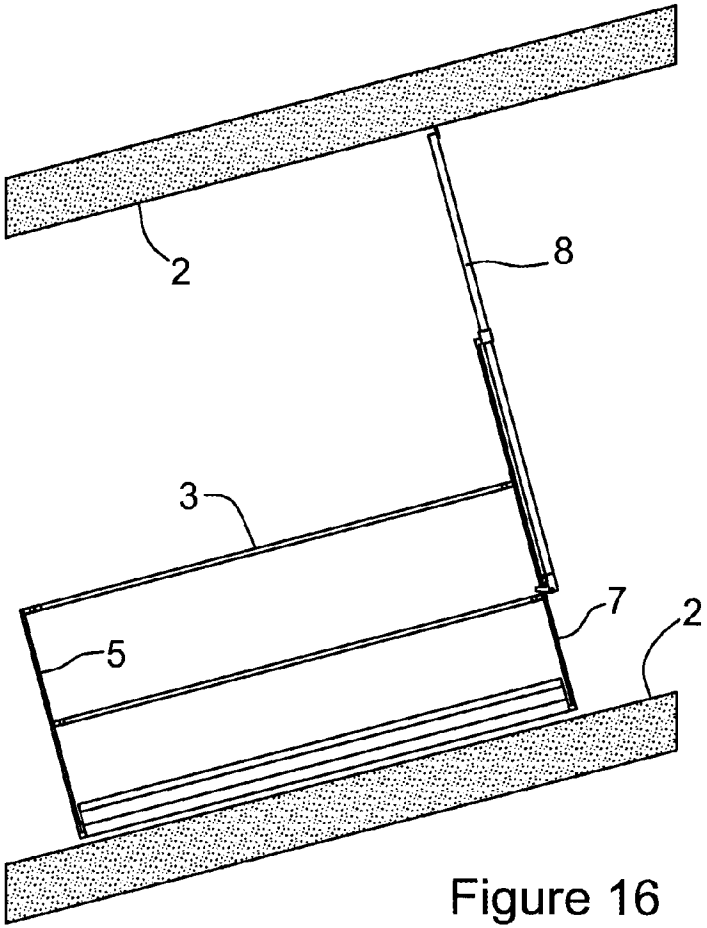
FIG. 16 is a side elevational view of an embodiment of the collapsible safety barrier and support post wherein the support post is anchored between two parallel and inclined surfaces at 90° to those surfaces.
Figure 17:
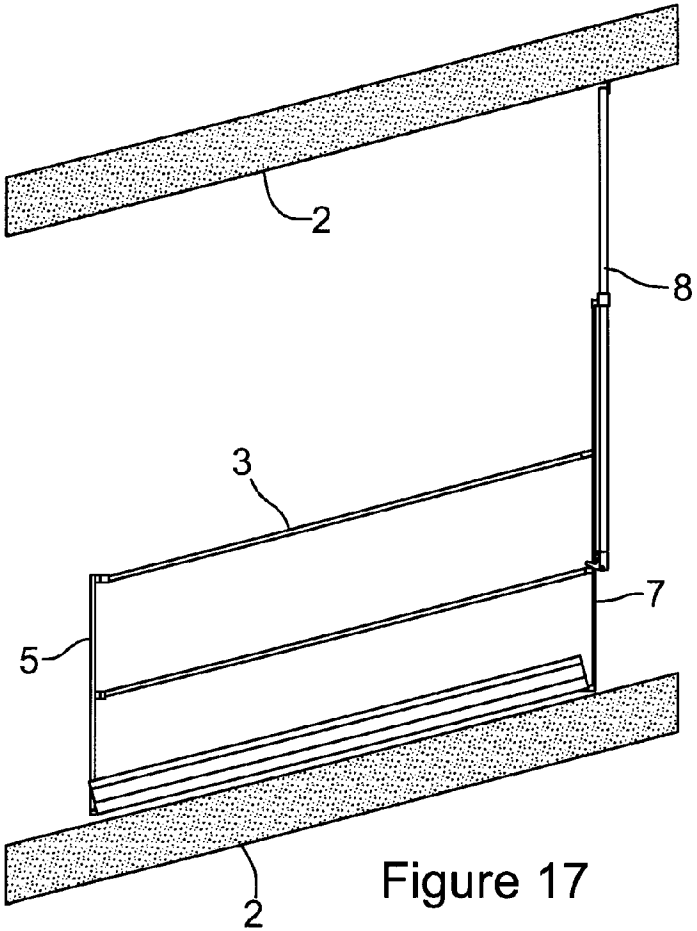
FIG. 17 is a side elevational view of an embodiment of the collapsible safety barrier and support post wherein the support post is mounted vertically between two inclined surfaces.

With reference to FIG. 10*a* through 10*c*, there is shown a side elevational view of the lower portion of the extension rail with lower spring 27 in its relaxed, cocked and "fired" configurations, similar to FIGS. 9 through 9*c*. However, in FIGS. 10*a* through 10*c* there is included a gauge 42 that visually depicts the "condition" of the spring. That is, through colour indication, gauge 42 will instantly provide an operator with the ability to determine whether the spring is (i) in a relaxed or non-compressed configuration (as in FIG. 10*a*), or (ii) in a compressed or "fired" position (as shown in FIGS. 10*b* and 10*c*). Gauge 42 will thus provide an operator with an easy, simple and reliable method to determine whether the support post portion of the collapsible safety barrier and support post is securely held between the floor and ceiling structures.

Further, one of ordinary skill will also appreciate that the described structure for the collapsible safety barrier and support post provides the ability for fence portion 100 to be rotated upwardly while support post portion 200 is fixed between the ceiling and floor structure (see FIG. 2*b*). Such an ability permits the fence portion to be lifted to allow for material or persons to move or be slid beneath the fence portion, to allow for accessing the floor structure for work that needs to be performed upon the floor structure, etc. In some instances it may also be desirable to fully rotate the fence portion 100 (which includes rails 3, kick board 12 and end post 5) to a vertical position (see FIG. 2*c*). When the fence portion has been rotated vertically as shown in FIG. 2*c*, a clasp, latch or other mechanism may be employed to retain it in a vertical position until such time as it is desired to rotate it back down horizontally and in contact with the floor structure. It will also be appreciated that in some embodiments the fence portion may be rotated in a horizontal manner (with the support post rotating about its longitudinal axis while still securing device 1 between the floor and ceiling structures) such that the fence portion may act as a gate that can be opened or closed as required.

With a thorough knowledge of the invention it will also be appreciated that the described collapsible safety barrier and support post provides a fast and simplified structure and methodology to install safety barriers and support posts on constructions sites and related applications. The described device also presents the ability the collapse the safety barrier and support post into a considerably smaller package to facilitate moving from place to place, and to minimize required storage space when not in use. The hinged connection between the longitudinal rails and the respective end posts allows for flexibility in use of the device, and in particular permits use on inclined surfaces. That same hinged connection permits the fence portion of the device to be easily lifted at one end to permit objects to be passed beneath the fence without having to disturb the support post.

It is to be understood that what has been described are the preferred embodiments of the invention. The scope of the claims should not be limited by the preferred embodiments set forth above, but should be given the broadest interpretation consistent with the description as a whole.

I claim:

1. A collapsible safety barrier and support post for releasably securing between a ceiling structure and a floor structure, the safety barrier and support post comprising:

a plurality of longitudinal rails having first portions hingedly secured to a first end post and having second end portions hingedly secured to a second post, an extension rail releasably engageable with said second end post, one of said second end post and said extension rail having floor engaging means and the other of said second end post and said extension rail having ceiling engaging means, said second end post and said extension rail together comprising the support post, an extension rail clamp configured to releasably secure said extension rail to said second end post while permitting sliding longitudinal movement of said extension rail relative to said second end post, said extension rail clamp having an engaged configuration where it restricts relative lateral movement between said second end post and said extension rail, and a disengaged configuration where it permits said extension rail to be laterally separated and removed from said second end post, and a latching mechanism to releasably secure said extension rail to said second end post, said latching mechanism having an engaged and a disengaged position, when in said engaged position said latching mechanism resisting relative longitudinal movement between said extension rail and said second end post, when in said disengaged position said latching mechanism permitting relative longitudinal movement between said extension rail and said second end post, said safety barrier having a deployed position and a collapsed position, when in said deployed position said floor engaging means engaged with the floor structure and said ceiling engaging means engaged with the ceiling structure, when in said collapsed position said longitudinal rails, said first and second end posts, and said extension rail positioned generally parallel and adjacent to one another and said ceiling engaging means disengaged from the ceiling structure.

2. The device as claimed in claim 1 wherein said safety barrier and support post, when secured between the ceiling and floor structures, is in a generally vertical plane.

3. The device as claimed in claim 1 including a longitudinal kick plate that is positioned adjacent to the floor structure when said safety barrier is releasably secured between the ceiling and floor structures.

4. The device as claimed in claim 1 including a carrying handle to facilitate the lifting and movement of the device when in said collapsed position.

5. The device as claimed in claim 1 wherein said second end post includes said floor engaging means and said extension rail includes said ceiling engaging means.

6. The device as claimed in claim 5 wherein said latching mechanism includes a spring, said spring biasing said ceiling engaging means toward the ceiling structure when said latching mechanism is in said engaged position.

7. The device as claimed in claim 6 wherein said extension rail includes an upper and a lower extension tube telescopically receivable within one another.

8. The device as claimed in claim 7 wherein said latching mechanism includes a clamping foot hingedly secured to said lower extension tube, said clamping foot slidably received about said second end post.

9. The device as claimed in claim 8 wherein said latching mechanism includes a second spring biasing said latching mechanism toward said disengaged position.

10. The device as claimed in claim 1 wherein said extension rail clamp includes a portion releasably received within a hollow upper end of said second end post when said extension rail clamp is in said engaged configuration, when said extension rail clamp in said disengaged configuration said portion removed from said hollow upper end of said second end post.

11. The device as claimed in claim 10 wherein said portion, releasably received within said hollow upper end of said second end post, is a hook.

12. The device as claimed in claim 11 wherein said extension rail clamp includes a tubular section slidably received over an exterior of said extension rail, the hook extending from said tubular section.

13. A collapsible safety barrier and support post for releasably securing between a ceiling structure and a floor structure, the safety barrier and support post comprising:

a plurality of longitudinal rails having first portions hingedly secured to a first end post and having second portions hingedly secured to a second end post, the second end post having a hollow upper end;

an extension rail releasably engageable with said second end post, one of said second end post and said extension rail having floor engaging means and the other of said second end post and said extension rail having ceiling engaging means, said second end post and said extension rail together comprising the support post;

an extension rail clamp to releasably secure said extension rail to said second end post while permitting sliding longitudinal movement of said extension rail relative to said second end post, said extension rail clamp comprising:

a tubular section that is slidably received over an exterior of said extension rail; and a male end extending from said tubular section, at least a portion of which is orientated parallel to said extension rail to be releasably received within said hollow upper end of said second end post, said extension rail clamp having an engaged configuration, where it restricts relative lateral movement between said second end post and said extension rail, and a disengaged configuration where it permits said extension rail to be laterally separated and removed from said second end post; and a latching mechanism to releasably secure said extension rail to said second end post, said latching mechanism having an engaged and a disengaged position, when in said engaged position said latching mechanism resisting relative longitudinal movement between said extension rail and said second end post, when in said disengaged position said latching mechanism permitting relative longitudinal movement between said extension rail and said second end post, said safety barrier having a deployed position and a collapsed position, when in said deployed position said floor engaging means engaged with the floor structure and said ceiling engaging means engaged with the ceiling structure, when in said collapsed position said longitudinal rails, said first and second end posts, and said extension rail positioned generally parallel and adjacent to one another and said ceiling engaging means disengaged from the ceiling structure.

14. The device as claimed in claim 13 wherein when said extension rail clamp is in said engaged configuration, the male end is releasably received within the hollow upper end of said second end post, and when said extension rail clamp is in said disengaged configuration, said male end is removed from said hollow upper end of said second end post.

* * * * *